US008715899B2

(12) United States Patent
Fukushima et al.

(10) Patent No.: US 8,715,899 B2
(45) Date of Patent: May 6, 2014

(54) CARRIER FOR TWO-COMPONENT DEVELOPER, TWO-COMPONENT DEVELOPER, IMAGE FORMING METHOD, AND IMAGE FORMING APPARATUS

(75) Inventors: Norihito Fukushima, Kanagawa (JP); Takeshi Shoji, Kanagawa (JP); Toshiaki Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/402,352

(22) Filed: Feb. 22, 2012

(65) Prior Publication Data

US 2013/0040236 A1 Feb. 14, 2013

(30) Foreign Application Priority Data

Aug. 12, 2011 (JP) ..... 2011-177227

(51) Int. Cl.
*G03G 9/113* (2006.01)

(52) U.S. Cl.
USPC ..... 430/111.35

(58) Field of Classification Search
USPC ..... 430/111.35
See application file for complete search history.

(56) References Cited

U.S. PATENT DOCUMENTS

| | | | | |
|---|---|---|---|---|
| 4,672,016 | A * | 6/1987 | Isoda et al. | 430/111.1 |
| 5,093,201 | A * | 3/1992 | Ohtani et al. | 428/407 |
| 5,225,302 | A * | 7/1993 | Isoda et al. | 430/111.33 |
| 6,235,443 | B1 | 5/2001 | Kayamoto et al. | |
| 2008/0070150 | A1 * | 3/2008 | Kobayashi et al. | 430/111.32 |
| 2010/0183964 | A1 * | 7/2010 | Yoshida et al. | 430/107.1 |
| 2011/0097662 | A1 * | 4/2011 | Vanbesien et al. | 430/111.31 |

FOREIGN PATENT DOCUMENTS

| | | |
|---|---|---|
| JP | A-49-91231 | 8/1974 |
| JP | A-56-040868 | 4/1981 |
| JP | A-07-219281 | 8/1995 |
| JP | A-2000-242044 | 9/2000 |
| JP | A-2006-079022 | 3/2006 |
| JP | A-2009-009000 | 1/2009 |
| JP | A-2009-186769 | 8/2009 |

* cited by examiner

*Primary Examiner* — Hoa V Le
(74) *Attorney, Agent, or Firm* — Oliff PLC

(57) ABSTRACT

A carrier for a two-component developer includes magnetic particles, and a resin coating layer that covers the magnetic particles. The resin coating layer contains metal boride particles having a volume average primary particle diameter of from about 300 nm to about 2,500 nm.

17 Claims, 3 Drawing Sheets

CARRIER FOR TWO-COMPONENT DEVELOPER, TWO-COMPONENT DEVELOPER, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-177227 filed Aug. 12, 2011.

BACKGROUND

1. Technical Field

The present invention relates to a carrier for two-component developer, a two-component developer, an image forming method, and an image forming apparatus.

2. Related Art

As in electrophotography or the like, methods of visualizing image information through an electrostatic latent image are widely used in various fields. In the electrophotography method, an electrostatic latent image on the surface of a photoconductor (image holding member) is developed through a charging process, an exposing process, or the like with a developer containing a toner, and the electrostatic latent image is visualized through a transferring process, a fixing process, or the like.

The developer includes a two-component developer composed of a toner and a carrier, and a single-component developer in which a toner is used alone like a magnetic toner or the like. Of these developers, the two-component developer has features, such as good controllability, and has recently been widely used because the carrier shares functions, such as stirring, transporting, and charging of the developer, and is functionally separated as a developer.

Additionally, for example, those described in Patent Documents 1 to 5 are known as the carrier or the two-component developer.

SUMMARY

According to an aspect of the invention, there is provided a carrier for a two-component developer including magnetic particles, and a resin coating layer that covers the magnetic particles. The resin coating layer contains metal boride particles having a volume average primary particle diameter of from about 300 nm to about 2,500 nm.

BRIEF DESCRIPTION OF THE DRAWINGS

Exemplary embodiments of the present invention will be described in detail based on the following figures, wherein.

DETAILED DESCRIPTION

Figure 1:
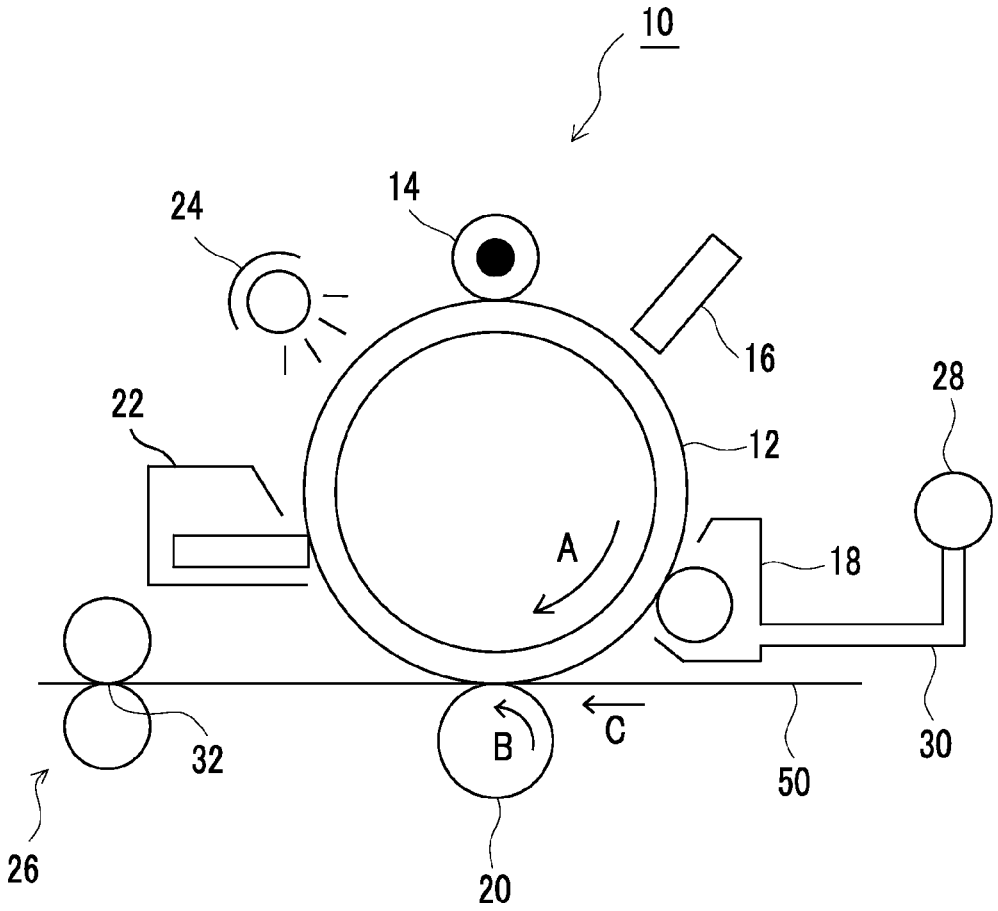
FIG. 1 is a cross-sectional view schematically showing the basic configuration of one preferred exemplary embodiment of an image forming apparatus of the present exemplary embodiment.

The present exemplary embodiment will be described below in detail. In addition, in the present exemplary embodiment, the expression "A to B" represents not only a range between A and B but a range including A and B at both ends.

(Carrier for Two-Component Developer)

A carrier for a two-component developer (hereinafter simply referred to as a "carrier") of the present exemplary embodiment has magnetic particles (hereinafter also referred to as a "core material"), and a resin coating layer that covers the magnetic particles, and the resin coating layer is characterized by containing metal boride particles having a volume average primary particle diameter of from 300 nm to 2,500 nm (or from about 300 nm to about 2,500 nm).

As a full color image, usually, an image is formed using C (cyan), N (magenta), Y (yellow), and K (black) toners. Combination colors other than these colors, for example, the red (or green) that is a secondary color may be formed by individually developing and transferring magenta and yellow (or cyan and yellow), controlling toners to be at predetermined positions after the transfer, melting the toners by heating and pressurization, and mixing the respective colors.

Although it is preferable that individual toner colors have no difference if possible in the amount of charge of toners that form a developer in order to form a combination color suitably, since the consumption amount of the toners varies according to the colors in practice, it is common that a difference may be caused in the amount of charge according to the individual color toners. Therefore, for example, in the case of an image in which thin lines in combination colors are formed after an image that has spent only one color toner in large quantities, the thin-line reproducibility of the image may deteriorate.

When the reproducibility of a green image formed by a yellow toner and a cyan toner is shown as an example, the yellow toner has much substitution and the cyan toner has little substitution if an image that spend only the yellow toner is formed. Thus, the amount of charge of the cyan toner becomes high with respect to the yellow toner. Thereafter, if a green image is formed, the yellow toner is first transferred to the intermediate transfer medium and then, the cyan toner is transferred onto the yellow toner. At that time, since the amount of charge of the cyan toner is high, deviation occurs at the place where a toner is to be transferred due to electrical repulsion with the yellow toner or the other cyan toner, and as a result, the thin-line reproducibility of the green image may deteriorate.

In order to suppress this problem, there is a method of adding conductive powder, such as metallic particles or carbon black, to a coating resin of the carrier so as to lower the resistance of the carrier and in order not to impart an excessive amount of charge to a toner. However, since stress, such as stirring, is excessively applied to the conductive powder when a coating layer is formed and when an image is formed using the carrier. Therefore, if the particle diameter is not appropriate, cracking or chipping of the conductive powder may occur, resistance control may become difficult, or chipping may interfere with other members.

The present inventors have studied in detail and consequently have found that metal boride with great hardness is used for the resin coating layer of the carrier for two-component developer and the particle diameter of the metal boride is controlled, whereby the hardness of the material is improved, stress concentration is suppressed, performance deterioration is controlled even while being used for a prolonged period of time, and preferable characteristics are shown. In addition, the inventors have found that the metal boride rarely affects the colorability of a toner even if development and transfer are made with chips being mixed in the toner.

Based on these findings, the present inventors have found that the deterioration of the thin-line reproducibility of the combination colors may be suppressed by causing metal boride having a specific average particle diameter to be contained in the resin coating layer of the carrier for two-component developer.

<Magnetic Particle>

The carrier for two-component developer of the present exemplary embodiment has magnetic particles (core material) and a resin coating layer that covers the magnetic particles.

Well-known materials may be used as the core material. Examples of the core material include magnetic metals, such as iron, nickel, and cobalt; alloys of these magnetic metals and manganese, chromium, rare earth, or the like; magnetic oxides, such as ferrous oxide, ferrite, and magnetite; and resin-dispersion-type core materials in which a conductive material or the like is dispersed in matrix resins.

Examples of the resin to be used in the resin-dispersion-type core material may include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins including organosiloxane bonds and modified products thereof, fluorine resins, polyester, polycarbonate, phenol resins, and epoxy resins.

The volume average particle diameter of the core material is preferably from 10 μm to 100 μm, and more preferably from 20 μm to 50 μm. If the volume average particle diameter of the core material is 10 μm or more, the adhesion force between a toner and the carrier is moderate, and the development amount of the toner is sufficiently obtained. On the other hand, if the volume average particle diameter of the core material is 100 μm or less, since a magnetic brush does not become coarse, an image with favorable thin-line reproducibility is formed.

As for the magnetic force of the core material, the saturation magnetization in 1,000 oersted is preferably from 50 emu/g to 100 emu/g, and more preferably from 60 emu/g to 100 emu/g. If the saturation magnetization is from 50 emu/g to 100 emu/g, since the hardness of the magnetic brush is kept moderate, the thin-line reproducibility may be improved and development of the carrier on a photoconductor together with a toner may be suppressed.

The volume average particle diameter d of the core material may be measured using a laser diffraction/scattering type particle diameter distribution measuring apparatus (LS Particle Diameter Analyzer: LS13 320 made by Beckmann Coulter Inc.). The obtained particle diameter distribution is divided into particle diameter ranges (channels), and the volume cumulative distribution is plotted from the smaller particle diameter side, and the particle diameter at cumulative 50% is defined as volume average particle diameter d.

Although an apparatus that may measure the magnetic properties is not particularly limited, a vibrating sample magnetometer VSM-P10-15 (made by Toei Industry Co., Ltd) is suitably used.

For example, a sample to be measured is filled into a cell having an internal diameter of 7 mm and a height of 5 mm, and then the cell is set into the apparatus. In the measurement, a magnetic field is applied to the sample, and sweeping up to a maximum value of 1,000 oersted is performed. Next, the applied magnetic field is reduced to prepare a hysteresis curve on recording paper. From the data of the curve, saturation magnetization, residual magnetization, and a retention force may be obtained. In addition, in the present exemplary embodiment, the saturation magnetization shows the magnetization measured in a magnetic field of 1,000 oersted.

The volume electric resistance (volume resistivity) of the core material is preferably within a range of from $10^5$ Ω·cm to $10^{9.5}$ Ω·cm (or from about $10^5$ Ω·cm to about $10^{9.5}$ Ω·cm), and more preferably within a range of from $10^7$ Ω·cm to $10^9$ Ω·cm (or from about $10^7$ Ω·cm to about $10^9$ Ω·cm). If the volume electric resistance is $10^5$ Ω·cm or more, when the concentration of a toner in a developer decreases due to repeated copying, injection of a charge to the carrier does not occur, and development of the carrier itself may be suppressed. On the other hand, if the volume electric resistance is $10^{9.5}$ Ω·cm or less, a conspicuous edge effect, a pseudo-outline portion, or the like may be suppressed, and image quality is excellent.

In the present exemplary embodiment, the volume electric resistance (Ω·cm) of the core material is measured as follows. In addition, as for measurement environment, temperature is set to 20° C., and humidity is set to 50% RH.

An object to be measured is flatly put on the surface of a circular jig in which a 20 $cm^2$ electrode plate is disposed so as to have a thickness of about 1 mm to 3 mm, whereby a layer is formed. The same 20 $cm^2$ electrode plate as above is put on the layer to sandwich the layer. In order to eliminate a gap between the objects to be measured, the thickness (cm) of the layer is measured after a 4 kg load is applied to the electrode plate laid on the layer. An electrometer and a high-voltage power generator are connected to both the electrodes above and below the layer. The volume electric resistance (Ω·cm) of the object to be measured is calculated by applying a high voltage is applied to both the electrodes so that an electric field may become $10^{3.8}$ V/cm, and reading a current value (A) that has flowed at this time. The calculation equation of the volume electric resistance (Ω·cm) of the object to be measured is as being shown in the following Equation.

$$R=E\times 20/(I-I_0)/L \qquad \text{Equation:}$$

In the above equation, R represents the volume electric resistance (Ω·cm) of the object to be measured, E represents an applied voltage (V), I represents a current value (A), $I_0$ represents the current value (A) at an applied voltage of 0 V, and L represents the thickness (cm) of the layer. Additionally, the coefficient of 20 represents the area ($cm^2$) of the electrode plate.

<Resin Coating Layer>

The carrier for a two-component developer of the present exemplary embodiment has magnetic particles, and a resin coating layer that covers the magnetic particles, and the resin coating layer contains metal boride particles having a volume average primary particle diameter of from 300 nm to 2,500 nm.

The metal borides in the metal boride particles may be, but are not particularly limited to, a compound in which a metal atom and a boron atom are coupled together.

The metal atom and the boron atom form metal borides of various kinds of compositions, and examples of the metal borides includes compounds having various structure, such as dimetal monoboride, pentametal triboride, metal monoboride, trimetal tetraboride, dimetal triboride, metal diboride, dimetal pentaboride, metal tetraboride, metal hexaboride, and metal dodecaboride. Additionally, metallic elements of the metal borides in the present exemplary embodiment may also include, but are not particularly limited to, Al and Si, in addition to the atypical elements of the first group to the twelfth group.

Specific examples of the metal borides may include $VB_2$, $NbB_2$, $TaB_2$, $CrB_2$, $HfB_2$, $ZrB_2$, $TiB_2$, WB, MoB, CrB, $LaB_6$, $CeB_6$, $GdB_6$, $TbB_6$, $DyB_6$, $HoB_6$, $YB_6$, $SmB_6$, $EuB_6$, $ErB_6$, $TmB_6$, $YbB_6$, $LuB_6$, $SrB_6$, $CaB_6$, $AlB_{10}$, $AlB_{12}$, $SiB_6$, and the like.

Among these, as the metal borides, from the viewpoint of the thin-line reproducibility of the combination colors, borides of the metals in the fourth group to the sixth group is preferable, diborides of the metals in the fourth group to the sixth group is more preferable, $VB_2$, $NbB_2$, $TaB_2$, $CrB_2$, $HfB_2$, or $ZrB_2$ is still more preferable, $VB_2$ or $CrB_2$ is especially preferable, and $VB_2$ is most preferable.

The volume average primary particle diameter of the metal boride particles is from 300 nm to 2,500 nm (or from about 300 nm to about 2,500 nm). From the viewpoint of the thin-line reproducibility of combination colors, from 500 nm to 2,200 nm (or from about 500 nm to about 2,200 nm) is preferable, and from 700 nm to 1,900 nm is more preferable.

The amount of the metal boride particles is preferably from 0.1% by weight to 30% by weight (or from about 0.1% by weight to about 30% by weight) to the total weight of the resin coating layer, more preferably from 0.5% by weight to 20% by weight, and still more preferably from 1% by weight to 15% by weight.

Examples of the resin to be used in the resin coating layer may include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins including organosiloxane bonds and modified products thereof, fluorine resins, polyester, polycarbonate, phenol resins, and epoxy resins.

Among these, as the resins to be used in the resin coating layer, homopolymer or copolymers of cycloalkyl methacrylate are preferable, and homopolymer or copolymers of cyclohexyl methacrylate is still more preferable in respect of compatibility with the metal borides and the control of amount of charge.

Additionally, as the resins to be used in the resin coating layer, homopolymers or copolymers of monomers expressed by the following Formula (2), that is, polymers having at least a monomer unit expressed by the following Formula (3) are preferable.

(2)

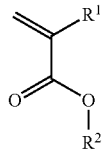

(3)

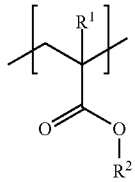

In Formulas (2) and (3), $R^1$ represents a hydrogen atom or a methyl group, and $R^2$ represents a cycloalkyl group.

From the viewpoint of the compatibility with the metal borides and the control of amount of charge, $R^1$ in Formulas (2) and (3) is preferably a methyl group.

From the viewpoint of the compatibility with the metal borides and the control of amount of charge, $R^2$ in Formulas (2) and (3) is preferably a cycloalkyl group of 5 to 7-membered rings, and more preferably a cyclohexyl group. Additionally, although the cycloalkyl group may have an alkyl group in respect of the ring structure thereof, the cycloalkyl group preferably does not have the alkyl group in respect of the ring structure thereof.

Conductive materials other than the metal borides may also be used for the resin coating layer. Specific examples of the conductive materials may include, but are not limited to, metals, such as gold, silver, and copper, carbon black, and titanium oxide, zinc oxide, barium sulfate, aluminum borate, potassium titanate, tin oxide, and the like. Among these, white electric conductive materials, such as zinc oxide and titanium oxide, are preferable as the conductive materials other than the metal borides. By using the white electric conductive materials, colorability in a toner image is not easily affected when a carrier piece is transferred to a transfer medium.

Additionally, the resin coating layer may contain a charge-controlling agent. The charge-controlling agent has easy control in a dispersed state, and has good adhesion with a coating resin interface, so that desorption of the charge-controlling agent from the resin coating layer may be suppressed. Additionally, the charge-controlling agent works as a dispersing aid of the conductive powder, the dispersed state of the conductive powder in the resin coating layer is made uniform, and a carrier resistance change may be suppressed even if the coating layer peels off slightly.

Examples of the charge-controlling agent may be well-known agents, such as nigrosine pigments, benzimidazole-based compounds, quaternary ammonium salt compounds, alkolxlated amines, alkyl amides, molybdic chelate pigment, triphenylmethane-based compounds, salicylic metal salt complexes, azo-based chromium complexes, and copper phthalocyanine. Among these, quaternary ammonium salt compounds, alkolxlated amines, and alkyl amides are preferable.

The additive amount of the charge-controlling agent is preferably from 0.001 part by weight to 5 parts by weight, and more preferably from 0.01 part by weight to 0.5 parts by weight when the core material has 100 parts by weight. If the additive amount of the charge-controlling agent is within the above range, the strength of the resin coating layer is sufficient, a carrier in which alteration does not easily occur due to the stress when used is obtained, and the dispersibility of the conductive materials is excellent.

Additionally, examples of the method of forming the resin coating layer on the surface of the core material of the carrier include, but are not particularly limited to, a method of performing coating using a resin-coating-layer forming solution in which resins, metal borides, and as required, various additives are dissolved or dispersed in a proper solvent and the like.

The solvent is not particularly limited and may be selected, in consideration of resins to be used, coating suitability, or the like.

Specific methods of forming the resin coating layer include a dipping method of dipping the core material of the carrier into the resin-coating-layer forming solution, a spraying method of spraying the resin-coating-layer forming solution on the surface of the core material of the carrier, a fluidized bed method of spraying the resin-coating-layer forming solution with the core material of the carrier being floated by fluidized air, a kneader/coater method of mixing the core material of the carrier with the resin-coating-layer forming solution in a kneader/coater and removing the solvent, and the like.

The average film thickness of the resin coating layer is preferably from 0.5 μm to 10 μm, more preferably from 1 μm to 5 μm, and still more preferably from 1 μm to 3 μm.

The average film thickness (μm) of the resin coating layer may be obtained according to the following Formula (A) when the true specific gravity of the core material is p (dimensionless), the volume average particle diameter of the core material is d (μm), the average specific gravity of the resin coating layer is $\rho_c$, and the total content of the resin coating layer with respect to the 100 parts by weight of the core material is $W_c$ (parts by weight).

Average film thickness (μm)={[Amount of coating resin per carrier (also including all additives, such as the conductive powder)/Surface area per carrier]}/Specific gravity of resin coating layer Equation (A):

$$= \{[4/3\pi \cdot (d/2)^3 \cdot \rho \cdot W_C]/[4\pi \cdot (d/2)^2]\}/\rho_C$$

$$= (1/6) \cdot (d \cdot \rho \cdot W_C/\rho_C)$$

The content of the resin coating layer in the carrier of the present exemplary embodiment is preferably from 0.1 part by weight to 20 parts by weight, more preferably from 0.5 part by weight to 10 parts by weight, and still preferably from 1 part by weight to 5 parts by weight to the 100 parts by weight of the core material. If the content of the resin coating layer is 0.1 part by weight or more, the surface exposure of the core material particles is low, and injection of a development electric field may be suppressed. Additionally, if the content of the resin coating layer is 20 parts by weight or less, less resin powder is isolated from the resin coating layer, and peeled-off resin powder in a developer may be suppressed from an early stage.

The coverage of the core material surface by the resin coating layer is preferably close to 100% as much as possible, more preferably 80% or more, and still more preferably 85% or more.

In addition, the coverage of the resin coating layer may be obtained by XPS measurement. As the XPS measuring apparatus, JPS80 manufactured by JEOL Co., Ltd. and measurement is carried out by using MgKα-ray as an X-ray source and setting an acceleration voltage to 10 kV and an emission current to 20 mV. The principal element(s) (usually, carbon) constituting the resin coating layer and the principal element(s) (for example, iron and oxygen when the core material is made of an iron-oxide-based material such as magnetite) are measured by the XPS measurement (in the following, description will be given assuming that the core material is made of an iron-oxide-based material). Here, C is spectrum is measured for carbon, $Fe2p_{3/2}$ spectrum is measured for iron, and O1s spectrum is measured for oxygen.

Based on the spectra for these individual elements, the element numbers ($A_C+A_O+A_{Fe}$) of carbon, oxygen, and iron are obtained. From the ratios of the element numbers thus obtained for carbon, oxygen, and iron, the iron content ratios of the core material alone and the carrier in which the core material is covered with the resin coating layer are obtained according to the following Equation (B). Then, the coverage is obtained according to the following Equation (C).

Iron content ratio (atomic %)$=A_{Fe}/(A_C+A_O+A_{Fe})\times 100$ Equation (B):

Coverage(%)={1−(Iron content ratio of carrier)/(Iron content ratio of core material alone)}×100) Equation (C):

In addition, when materials other than the iron-oxide-based material are used, the coverage may be obtained if the spectra of the metallic elements constituting the core material other than oxygen are measured, and the same calculation is performed according to the above-mentioned equation (B) or (C).

<Properties of Carrier>

The volume average particle diameter of the carrier is preferably from 10 μm to 100 μm, and more preferably from 20 μm to 50 μm. If the volume average particle diameter of the carrier is 10 μm or more, carrier contamination is low. Additionally, if the volume average particle diameter of the carrier is 100 μm or less, deterioration of the thin-line reproducibility may be suppressed.

The volume average particle diameter of the carrier is measured using a laser diffraction/scattering type particle diameter distribution measuring apparatus (LS Particle Diameter Analyzer: LS13 320 made by Beckmann Coulter Inc.).

Additionally, the shape factor SF1 of the carrier is preferably from 100 to 145. If the shape factor is within the above range, charging control is easy because the proper hardness of the magnetic brush may be held, and the agitating efficiency of a developer does not easily decline.

In addition, the shape factor SF1 of the carrier means a value calculated according to the following Equation (D).

$$SF1=100\pi\times(ML)^2/(4\times A) \quad \text{Equation (D):}$$

Here, ML is the maximum length of carrier particles and A is the projected area of the carrier particles.

In addition, the maximum length and projected area of the carrier particles are obtained by observing carrier particles sampled on a slide glass with an optical microscope, incorporating an image of the carrier particles into an image analysis apparatus (LUZEXIII made by NIRECO Inc.) through a video camera, and performing image analysis on the incorporated image. The number of samplings in this case is 100 or more, and the shape factor shown in Equation (D) is calculated using the average value thereof.

The saturation magnetization of the carrier is preferably from 40 emu/g to 100 emu/g, and more preferably from 50 emu/g to 100 emu/g.

As an apparatus for measurement of magnetic properties the vibrating sample magnetometer VSM-P10-15 (made by Toei Industry Co., Ltd) is used. A sample to be measured is filled into a cell having an internal diameter of 7 mm and a height of 5 mm, and then the cell is set into the apparatus. In the measurement, a magnetic field is applied to the sample, and sweeping up to a maximum value of 1,000 oersted is performed. Next, the applied magnetic field is reduced to prepare a hysteresis curve on recording paper. From the data of the curve, saturation magnetization, residual magnetization, and a retention force are obtained. In the present exemplary embodiment, the saturation magnetization shows the magnetization measured in a magnetic field of 1,000 oersted.

Although the volume electric resistance of the carrier is preferably controlled within a range of from $1\times10^7$ Ω·cm to $1\times10^{15}$ Ω·cm (or from about 1×10 Ω·cm to about $1\times10^{15}$ Ω·cm), the volume electric resistance of the carrier is more preferably within a range of from $1\times10^8$ Ω·cm to $1\times10^{14}$ Ω·cm, and still more preferably within a range of from $1\times10^8$ Ω·cm to $1\times10^{13}$ Ω·cm.

If the volume electric resistance of the carrier is $1\times10^{15}$ Ω·cm or less, the resistance does not become high, excellently working as a development electrode upon development. Particularly, the edge effect does not occur in a solid image part, and solid reproducibility is excellent. On the other hand, if the volume electric resistance is 1×10 Ω·cm or more, the resistance is moderate, injection of a charge into the carrier from a developing roller does not easily occur when the concentration of a toner in a developer is reduced, and a phenomenon that the carrier itself is developed does, not easily occur.

Additionally, it is preferable to measure the volume electric resistance of the carrier similarly to the volume electric resistance of the core material.

(Two-Component Developer)

The two-component developer (hereinafter also referred simply to as "developer") of the present exemplary embodiment is a two-component developer containing a carrier for two-component development of the present exemplary embodiment and a toner for electrostatic charge image development.

The mixing ratio (weight ratio) of the toner for electrostatic charge image development and the carrier of the present exemplary embodiment in the two-component developer is preferably within a range of toner:carrier=1:100 to 10:100, and more preferably within a range of 3:100 to 8:100.

The two-component developer of the present exemplary embodiment is applied not only as a developer accommodated in advance in a developing unit (developer accommodating container), but also as a developer for supply to be used in, for example, a trickle development system or the like.

The mixing ratio (weight ratio) of the toner for electrostatic charge image development and the carrier of the present exemplary embodiment in the developer for supply is preferably within a range of toner:carrier=20:1 to 1:1, and more preferably within a range of 20:1 to 10:1.

The two-component developer of the present exemplary embodiment is particularly suitably used as a two-component developer for trickle development.

Toner for Electrostatic Charge Image Development

Although well-known toners may be used with no particular limitations as the toner for electrostatic charge image development to be used in the present exemplary embodiment, a colored toner having a binder resin and a colorant is preferably exemplified.

Additionally, the toner for electrostatic charge image development preferably contains a binder resin and a colorant, and more preferably a binder resin, a colorant, and a release agent.

<Binder Resin>

The toner for the electrostatic charge image development contains a binder resin.

The kind of the binder resin is not particularly limited, and well-known resins may be used.

Although examples of the binder resin include polyester resins, polyalkylene resins, long-chain alkyl (meta) acrylate resins, and the like, it is preferable to use the polyester resins from the viewpoints of more appearance of an abrupt change in viscosity caused by heating and compatibility between mechanical strength and fixability.

The polyester resins will mainly be described in behalf of the binder resin.

From the viewpoints of storage performance and low-temperature fixability, the melting temperature of the polyester resins to be used in the present exemplary embodiment is preferably within a range of 50° C. or higher and 100° C. or lower, more preferably within a range of 55° C. or higher and 90° C. or lower, and still more preferably within a range of 60° C. or higher and 85° C. or lower. If the melting temperature is 50° C. or lower, blocking may be kept from occurring in a stored toner, and toner storage performance and the storage performance of a fixed image after fixing are excellent. Additionally, if the melting temperature is 100° C. or lower, sufficient fixability is obtained.

In addition, the melting temperature and glass transition temperature of the above polyester resins are obtained as the peak temperature of an endothermic peak obtained by the differential scanning calorimetry (DSC).

In the present exemplary embodiment, the "polyester resins" also mean polymers (copolymers) obtained by polymerizing both components constituting polyester and other components, in addition to the polymers whose constituent is 100% polyester structure. It is to be noted that, in the latter case, other constituents other than the polyester constituting the polymers (copolymers) shall be 50% by weight or less.

The polyester resin to be used in the toner for electrostatic charge image development is synthesized from, for example, a polyvalent carboxylic component and a polyol component. In addition, in the present exemplary embodiment, a commercial item or a synthesized item may be used as the polyester resin.

Examples of the polyvalent carboxylic component include, but not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids including a dibasic acid such as phthalic acid, isophthalic acid, terephthalic acid, naphthalene-2,6-dicarboxylic acid, malonic acid, mesaconic acid; and anhydrides and lower alkyl esters thereof.

Examples of a trivalent or higher-valent carboxylic acid include specific aromatic carboxylic acids such as 1,2,3-benzene tricarboxylic acid, 1,2,4-benzene tricarboxylic acid, 1,2,4-naphthalene tricarboxylic acid; and anhydrides and lower alkyl esters thereof. These compounds may be used singly or in combination of two or more kinds thereof.

As the polyol component, an aliphatic diol is preferable, and a straight-chain aliphatic diol having from 7 to 20 carbon atoms in the main chain thereof is more preferable. If the aliphatic diol is of a straight-chain type, the crystallinity of the polyester resin is sufficient, and the melting temperature is moderate. Additionally, if the carbon number of a main chain part is 7 or more, when condensation polymerization with an aromatic dicarboxylic acid is conducted, the melting temperature is moderate, and low-temperature fixing is easy. Additionally, if the carbon number of the main chain part is 20 or less, acquisition of a practical material is easy. The carbon number of the main chain part is more preferably 14 or less.

Examples of the aliphatic diol suitably used for synthesizing the polyester resin to be used in the toner for electrostatic charge image development specifically include but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among these, 1,8-octanediol, 1,9-nonanediol and 1,10-decanediol are preferable when availability is taken into consideration.

Examples of the trivalent or higher-valent alcohol include glycerin, trimethylol ethane, trimethylol propane and pentaerythritol. These compounds may be used singly or in combination of two or more kinds thereof.

The content of the aliphatic diol in the polyol component is preferably 80 mol % or more, and more preferably 90 mol % or more. If the content of the aliphatic diol is 80 mol % or more, the glass transition temperature is sufficient high, toner blocking resistance, the image shelf life and fixability are excellent.

Examples of catalysts to be available when the polyester resins are prepared include alkaline metallic compounds, such as sodium and lithium; alkaline earth metal compounds, such as magnesium and calcium; metallic compounds, such as zinc, manganese, antimony, titanium, tin, zirconium, and germanium; phosphorous acid compounds; phosphoric acid compounds; amine compounds, and the like.

The weight average molecular weight (Mw) of the polyester resins is preferably from 6,000 to 35,000. If the molecular weight (Mw) is 6,000 or more, permeation of a toner into the surface of a recording medium, such as paper, at fixing, is low, the thin-line reproducibility may be suppressed, and the strength of a fixed image to bending resistance is also excellent. Additionally, if the weight average molecular weight (Mw) is 35,000 or less, the viscosity at the time of melting is moderate, it is not necessary to raise the temperature for reaching a proper viscosity for fixing, and as a result, fixability, such as the colorability of the combination colors, is excellent.

The weight average molecular weight may be measured by the gel permeation chromatography (GPC). The measurement of the molecular weight by the GPC is performed in a tetrahydrofuran (THF) solvent, using GPC HLC-8120 by TOSOH CORP. as a measuring apparatus, and using Column TSKgel SuperHM-M (15 cm) made by TOSOH CORP. The weight average molecular weight is calculated from the result of this measurement, using a molecular weight calibration curve plotted using a monodispersed polystyrene standard sample.

The binder resin containing the above polyester resins preferably has polyester resins synthesized using aliphatic polymerizable monomers, as a principal component (50% by weight or more). Moreover, in this case, the composition ratio of the aliphatic polymerizable monomers constituting the polyester resins is preferably 60 mol % or more. In addition, as the aliphatic polymerizable monomers, the aforementioned aliphatic diols or dicarboxylic acids are suitably used.

<Colorant>

The toner for electrostatic charge image development preferably contains a colorant.

Additionally, the toner for electrostatic charge image development may constitute a toner set together with at least a kind of colored toner selected from a group composed of a cyan toner, a magenta toner, a yellow, toner, and a black toner.

Although the colorant to be used in the colored toner may be dyes or pigments, the pigments are preferable from the viewpoint of light resistance or waterproofness.

As the colorant, well-known pigments such as carbon black, aniline black, aniline blue, Chalcoyl Blue, Chrome Yellow, Ultramarine Blue, DuPont Oil Red, Quinoline Yellow, Methylene Blue Chloride, Phthalocyanine Blue, Malachite Green Oxalate, Lamp Black, Rose Bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3 may be used.

The content of the colorant in a colored toner is preferably within a range of from 1 part by weight to 30 parts by weight to 100 parts by weight of the binder resin. Additionally, it is also effective to use a colorant subjected to surface treatment as required or to use a pigment dispersing agent.

By selecting the kind of the colorant, colored toners, such as a yellow toner, a magenta toner, a cyan toner, and a black toner, may be obtained.

<Release Agent>

The toner for electrostatic charge image development preferably contains a release agent.

Examples of the release agent includes paraffin waxes, such as low-molecular-weight polypropylene or low-molecular-weight polyethylene; silicone resin; rosins; rice wax; carnauba wax, ester wax, montan wax, and the like. Among these, paraffin wax, ester wax, montan wax, and the like are preferable, and paraffin wax, ester wax, and the like are more preferable.

The content of the release agent in a toner is preferably from 0.5% by weight to 15% by weight.

<Other Additives>

In addition to the above components, various well-known components, such as internal additives, charge-controlling agents, inorganic powders (inorganic particles), and organic particles may be further added to the toner for the electrostatic charge image development as required.

Examples of the internal additives includes magnetic substances, such as metals, such as ferrite, magnetite, reduced iron, cobalt, nickel, and manganese, alloys, compounds containing these metals, and the like.

Although the inorganic particles may be added for various purposes, the inorganic particles may be added for the adjustment of viscoelasticity in a toner. Image glossiness or permeation into paper may be adjusted by this viscoelasticity adjustment. As the inorganic particles, well-known inorganic particles, such as silica particles, titanium oxide particles, alumina particles, cerium oxide particles, substances obtained by the hydrophobic treatment of the surfaces of these particles, and the like may be used singly or in combination of two or more kinds thereof.

The toner for electrostatic charge image development may have external additives represented by silica, titania, and aluminum oxide for the purpose of charging adjustment, fluidity impartment, charge exchangeability impartment, or the like. These external additives may be made to adhere in divided steps by, for example, a V-type blender, a Henschel mixer, a Lodige mixer, or the like.

Although examples of the external additives to be used in the present exemplary embodiment include well-known external additives, it is preferable to use inorganic particles.

Examples of the inorganic particles include silica, alumina, titanium oxide, barium titanate, magnesium titanate, calcium titanate, strontium titanate, zinc oxide, silica sand, clay, mica, wollastonite, diatomaceous earth, cerium chloride, colcothar, chromium oxide, cerium oxide, antimony trioxide, magnesium oxide, zirconium oxide, silicon carbide and silicon nitride. Among these particles, silica particles and/or titania particle are preferable, and hydrophobized silica particles and/or titania particles are particularly preferable.

The inorganic particles are generally used for the purpose of improving the fluidity of a toner. The volume average particle diameter of the inorganic particles is preferably within a range of from 1 nm to 40 nm and more preferably within a range of from 5 nm to 20 nm in a primary particle diameter. Additionally, the volume average particle diameter of the inorganic particles is preferably from 50 nm to 500 nm for the purpose of improving transferability. These inorganic particles are preferably subjected to surface reforming, such as hydrophobizing, in terms of stabilizing chargeability and developability.

The additive amount of the external additives is preferably within a range of from 0.1 part by weight to 5 parts by weight and more preferably within a range of from 0.3 part by weight to 2 parts by weight to 100 parts by weight of toner particles. If the additive amount is 0.1 part by weight or more, the fluidity of a toner is moderate, chargeability is excellent, and charge exchangeability is excellent. On the other hand, if the additive amount is 5 parts by weight or less, a coating state is moderate, the external additives may be kept from shifting to a contacting member, and occurrence of secondary damage is suppressed.

Although the charge-controlling agents are not particularly limited, colorless or light-colored charge-controlling agents may be preferably used. Examples of the charge-controlling agents include quaternary ammonium salt compounds, nigrosine-based compounds, complexes of aluminum, iron, and chromium, triphenylmethane-based pigments, and the like.

<Properties for Electrostatic Charge Image Development>

The volume average particle diameter of the toner for electrostatic charge image development is preferably within a range of from 4 μm to 9 μm. If the volume average particle diameter is 4 μm or more, toner fluidity is excellent, a difference in amount of charge between toners is small, and even if a toner with a large amount of charge is used, the thin-line reproducibility of the combination colors is excellent. Additionally, charging distribution is narrow, fogging of the background, spilling of a toner from a developer unit or the like is suppressed, and the colorability of an image is excellent.

In addition, it is preferable to use a Coulter Multisizer II type (made by Beckmann Coulter Inc.) for the measurement of the volume average particle diameter of a toner, and use ISOTON-II (made by Beckmann Coulter Inc.) as an electrolyte.

A specific example of the measurement method includes the following method.

1.0 mg of a sample to be measured is added to a surfactant as a dispersant, preferably, 2 ml of a 5% aqueous solution of sodium alkylbenzene sulfonate. This sample is added to 100 ml of the electrolyte so as to prepare an electrolyte having the sample suspended. Volume average distribution and number average distribution are obtained by performing dispersion treatment on the electrolyte having the sample suspended therein for 1 minute in an ultrasonic disperser, measuring the particle diameter distribution of from 1 μm to 30 μm particles, using 50 μm aperture as an aperture diameter, by means of the Coulter multisizer II type. In addition, the number of particles to be measured is 50,000.

Additionally, the particle diameter distribution of the toner for electrostatic charge image development is preferably narrower. More specifically, a volume-average particle diameter-distribution index (GSDv) obtained by converting the volume particle diameters of toners from a smaller one to show the ratio of a 16% diameter (abbreviated as $D_{16v}$) and an 84% diameter ($D_{84v}$) as a square root, that is GSDv expressed by the following Equation is preferably 1.21 or less, more preferably 1.19 or less, and particularly preferably 1.17 or less.

$$GSDv=\{(D_{84v})/(D_{16v})\}^{0.5} \quad (1)$$

In Equation (1), $D_{84v}$ and $D_{16v}$ are respectively particle diameters that become cumulative 84% and cumulative 16% when a volume cumulative distribution curve is drawn from the smaller particle diameter side with respect to the divided particle diameter ranges.

If GSDv is within the above range, since generation of particles in which the amount of toner charge becomes excessively large is suppressed, deterioration of the thin-line reproducibility of the combination colors is further suppressed.

Moreover, in the toner for electrostatic charge image development, the shape factor SF1 is preferably within a range of 110 to 140 or less. Since the shape is spherical within this range, transfer efficiency and the compactness of an image are improved and a high-quality image is formed.

Here, the above shape factor SF1 is calculated according to the following Equation (E).

$$SF1=(ML^2/A)\times(\pi/4)\times 100 \quad \text{Equation (E)}$$

In the above Equation (E), ML represents the absolute maximum length of a toner, and A represents the projected area of the toner.

The SF1 is quantified by analyzing mainly a microscopic image or a scanning electron microscope (SEM) image using an image analysis apparatus, and may be calculated as follows, for example. That is, the SF1 is obtained by incorporating an optical microscope image of particles dispersed on the surface of the slide glass into a Luzex image analysis apparatus through a video camera, obtaining the maximum length and projected area of 100 particles, performing the calculation according to the above Equation (E), and obtaining the average value thereof.

<Method for Producing Toner for Electrostatic Charge Image Development>

The method for producing the toner for electrostatic charge image development is not particularly limited, and the toner is prepared by dry methods, such as a well-known kneading and pulverizing production method, and wet methods, such as emulsification aggregation method or suspension polymerization method, or the like. Among these methods, the emulsification aggregation method capable of easily preparing a toner with core material shell structure is preferable.

A method for producing the toner according to the exemplary embodiment by an emulsion aggregation method will be described below in detail.

The emulsion aggregation method includes an emulsifying process of emulsifying raw materials constituting the toner to form resin particles (emulsion particles), an aggregation process of forming an aggregate of the resin particles, and a coalescence process of coalescing the aggregate.

[Emulsifying Process]

For example, preparation of a resin particle dispersion liquid is preferably performed by applying a shearing force with a dispersing machine to a solution in which a water-based medium and a resin are mixed. In that case, particles are preferably formed by lowering the viscosity of a resin component by heating. Additionally, a dispersant may be used for stabilization of the dispersed resin particles. Furthermore, when an oil-based resin is used and the resin dissolves in a solvent whose solubility in water is relatively low, a resin particle dispersion liquid may be prepared by dissolving the resin in the solvents, then dispersing the resin as particles in a water-based medium together with a dispersant or a polymer electrolyte, and then evaporating the solvent from the resultant mixture by heating or reducing the pressure.

Examples of the water-based medium include water, such as distilled water or ion-exchanged water; and alcohols, and the water-based medium is preferably water alone.

Additionally, examples of a dispersant to be used in the emulsifying process include water-soluble polymers, such as polyvinyl alcohol, methylcellulose, ethyl cellulose, hydroxyethylcellulose, carboxymethylcellulose, sodium polyacrylate, or sodium polymethacrylate; surfactants, such as anionic surfactants, such as sodium dodecylbenzenesulfonate, octadecylsodium sulfate, sodium oleate, sodium laurylate, or potassium stearate, cationic surfactants, such as lauryl amine acetate, stearylamine acetate, or lauryl trimethyl ammonium chloride, amphoteric ionic surfactants, such as lauryldimethyl amine oxide, nonionic surfactants, such as polyoxyethylene alkyl ether, polyoxyethylene alkyl phenyl ether, or polyoxyethylene alkylamine; and inorganic salts, such as tricalcium phosphate, aluminum hydroxide, calcium sulfate, calcium carbonate, or barium carbonate.

Examples of the dispersing machine to be used in the preparation of the emulsified liquid include a homogenizer, a homomixer, a pressurizing kneader, an extruder, and a media dispersing machine.

As the size of the resin particles, the average particle diameter (volume average particle diameter) thereof is preferably within a range of from 60 nm to 300 nm, and more preferably within a range of from 150 nm to 250 nm. When the average particle diameter is within the above ranges, the aggregation properties of the resin particles are sufficient, and the particle diameter distribution of toner may be narrowed.

For preparation of a release agent dispersion liquid, a release agent is dispersed in water together with an ionic surfactant or a polymer electrolyte, such as a polymeric acid or a polymeric base, and then the resultant mixture is heated to a temperature equal to or higher than the melting point of the release agent and dispersed using a homogenizer or a pressure-discharge-type dispersing machine capable of applying a strong shearing force. The release agent dispersion liquid may be obtained through such treatment.

By the dispersion treatment, the release agent dispersion liquid containing release agent particles having a volume average particle diameter of, preferably, 1 μm or lower may be obtained. In addition, a more preferable volume average particle diameter of the release agent particles is from 100 nm to 500 nm.

[Aggregation Process]

In the aggregation process, preferably, the resin particle dispersion liquid, the release agent dispersion liquid, the colorant particle dispersion liquid, and the like, are mixed to be used as a mixed liquid, and the mixed liquid is heated at a temperature equal to or lower than the glass transition temperature of amorphous resin particles for aggregation to form aggregated particles. The aggregated particles are formed by, for example, making the pH of the mixed liquid acidic under stirring.

The pH is preferably within a range of from 2 to 7, more preferably within a range of from 2.2 to 6, and is still more preferably within a range of from 2.4 to 5 from the viewpoint that the particle diameter distribution of toner is narrowed. In this case, the use of an aggregating agent may be effective.

In addition, in the aggregation process, the release agent dispersion liquid may be added and mixed at once together with various dispersion liquids, such as a resin particle dispersion liquid, or may be divided into several portions and added in a divided manner.

As the aggregating agent, a surfactant having a polarity reverse to that of the surfactant to be used in the dispersant, an inorganic metal salt, or a di- or higher valent metal complex may be suitably used. Particularly when a metal complex is used, the used amount of the surfactant may be reduced and chargeability improves, and thus the use of the metal complex is particularly preferable.

Examples of the inorganic metal salts include metal salts, such as calcium chloride, calcium nitrate, barium chloride, magnesium chloride, zinc chloride, aluminum chloride, and aluminum sulfate, inorganic metal salt polymers, such as polyaluminum chloride, polyaluminum hydroxide, and calcium polysulfide, and the like. Among these, the aluminum salts and polymers thereof are particularly suitable. A toner with smaller GSDv is obtained by increasing the number of times of addition of the inorganic metal salts.

Additionally, by additionally adding the resin particle dispersion liquid when the particle diameter of the aggregated particles reaches a desired particle diameter (coating process), a toner having a structure in which the surfaces of the core aggregated particles are covered with the resin particles may be prepared. In this case, since the release agent is less likely to be exposed on the surface of a toner, such a structure is preferable from the viewpoint of chargeability or developability. When the resin particle dispersion liquid is additionally added, an aggregating agent may be added or the pH may be adjusted before the additionally adding of the resin particle dispersion liquid.

[Coalescence Process]

In the coalescence process, preferably, the progress of aggregation is stopped by increasing the pH of a suspension of aggregated particles to be within a range of from 3 to 9 under stirring conditions according to the aggregation process, and the aggregated particles are coalesced by heating at a temperature equal to or higher than the melting temperature of the crystalline resin. Additionally, when the aggregated particles are covered with the amorphous resin, it is preferable that the amorphous resin be also coalesced to cover the core aggregated particles. The heating may be performed for a period of time coalescence may be effected, and may be performed for, preferably, 5 hours to 10 hours.

The resultant mixture is cooled after coalescence, and coalesced particles are obtained. Additionally, in the cooling process, near the melting temperature of the crystalline resin (in the range of ±10° C. of the melting temperature), the cooling rate may be reduced, that is, the mixture is gradually cooled so that crystallization may be accelerated.

The coalesced particles obtained by coalescence may be formed into toner particles through a solid-liquid separation process, such as filtration, and, as required, a washing process and a drying process.

Additionally, it is preferable to externally add an external additive to the obtained toner particles.

Moreover, as required, coarse particles of a toner may be removed using an ultrasonic sieving machine, a vibration sieving machine, a wind classifier, or the like after the external addition.

(Cartridge, Process Cartridge, Image Forming Method, And Image Forming Apparatus)

Next, the cartridge of the present exemplary embodiment will be described.

The cartridge of the present exemplary embodiment is a cartridge that accommodates at least a carrier for a two-component developer of the present exemplary embodiment or a two-component developer of the present exemplary embodiment. Additionally, the cartridge of the present exemplary embodiment is preferably detachable from an image forming apparatus.

In the image forming apparatus, image formation that is excellent in the thin-line reproducibility of combination colors may be performed by using the cartridge of the present exemplary embodiment that accommodates the two-component developer of the present exemplary embodiment.

Here, when the cartridge of the present exemplary embodiment is used particularly for an image forming apparatus of a trickle development system, a cartridge that accommodates the two-component developer of the present exemplary embodiment may be used, or a cartridge that independently accommodates a toner and a cartridge that independently accommodates the carrier of the present exemplary embodiment may be separately used.

Although the image forming method of the present exemplary embodiment is not particularly limited as long as it is an image forming method using the carrier of the present exemplary embodiment, preferably, the method includes a charging process of charging at least an image holding member; an exposing process of forming an electrostatic latent image on the surface of the image holding member; a developing process of developing the electrostatic latent image formed on the surface of the image holding member with an electrostatic charge image developer to form a toner image; and a transferring process of transferring the toner image formed on the surface of the image holding member to the surface of a transfer medium, and the electrostatic charge image developer is the two-component developer of the present exemplary embodiment. The image forming method of the present exemplary embodiment may further include a fixing process of fixing the toner image.

An example of the image forming method of the present exemplary embodiment includes a method including preparing a developer with the use of the carrier of the present exemplary embodiment, forming and developing an electrostatic image using the developer by a commonly-used electrophotographic copying machine, electrostatically transferring the obtained toner image to transfer paper and then fixing the image by means of a heating roller fixing device in which the temperature of a heating roller is set to a constant temperature, and forming a copy image.

Additionally, the carrier for a two-component developer of the present exemplary embodiment may be used for an image forming method of an ordinary electrostatic charge image development system (electrophotographic system). Specifically, the image forming method of the present exemplary embodiment is preferably a method including, for example, an electrostatic latent image forming process, a developing process, a transferring process, and a cleaning process. The respective processes are general processes in themselves, and are described in, for example, in JP-A-56-40868, JP-A-49-91231, and the like. In addition, the image forming method of the present exemplary embodiment may be carried out using image forming apparatuses, such as a copying machine and a facsimile machine that are well-known in themselves.

The electrostatic latent image forming process is a process of forming an electrostatic latent image on an image holding member.

The developing process is a process of developing the electrostatic latent image by a developer layer on a developer carrier to form a toner image. The developer layer is not particularly limited if the layer includes a toner for electrostatic charge image development and the carrier for a two-component developer of the present exemplary embodiment (the two-component developer of the present exemplary embodiment).

The transferring process is a process of transferring the toner image onto a transfer medium. Additionally, examples of the transfer medium in the transferring process may include an intermediate transfer medium, and recording media such as paper.

In the fixing process, the toner image transferred to the transfer paper is fixed by the heating roller fixing device in which the temperature of a heating roller is set to a constant temperature, whereby a copy image is formed.

The cleaning process is a process of removing the electrostatic charge image developer that remains on the image holding member.

In the image forming method of the present exemplary embodiment, an aspect further including a recycling process is preferable. The recycling process is a process of moving the toner for electrostatic charge image development collected in the cleaning process to the developer layer. The image forming method of the aspect including this recycling process may be carried out using image forming apparatuses, such as a toner recycling system type copying machine and a toner recycling system type facsimile machine. Additionally, the image forming method may also be applied to a recycling system of an aspect in which the cleaning process is omitted, and the toner is simultaneously collected with development.

Although the image forming apparatus of the present exemplary embodiment is not particularly limited if it is an image forming apparatus using the carrier of the present exemplary embodiment, preferably, the apparatus includes an image holding member; a charging unit that charges the image holding member; an exposure unit that exposes the charged image holding member to form an electrostatic latent image on the image holding member; a developing unit that develops the electrostatic latent image with a developer to form a toner image; and a transfer unit that transfers the toner image from the image holding member to a transfer medium, and the electrostatic charge image developer is the two-component developer of the present exemplary embodiment. In addition, the image forming apparatus of the present exemplary embodiment may include a fixing unit, a cleaning unit, an erasing unit, or the like as required in addition to the image holding member, the charging unit, the exposure unit, the developing unit, and the transfer unit.

In the transfer unit, transfer may be performed two or more times using an intermediate transfer medium. Additionally, examples of the transfer medium in the transfer unit may include an intermediate transfer medium or recording media, such as paper.

Additionally, the developing unit may adopt a configuration in which a developer accommodating container for storing the developer of the present exemplary embodiment, a developer supply unit for supplying the developer to the developer accommodating container, and a developer discharge unit for discharging at least a portion of the developer accommodated in the developer accommodating container, that is, the trickle development system.

If a resin coating carrier from which a resin coating layer is easily peeled off is used when using such a trickle development system is used, not only peeling-off of the resin coating layer in the developer already accommodated in the developer accommodating container occurs, but also peeling-off of the resin coating layer in the developer to be supplied upon occasion to the developer accommodating container from the developer supply unit occurs. As a result, the influence exerted by the peeled-off carrier resin powder becomes large compared to a case where the trickle development system is not used, and it becomes more difficult to obtain the thin-line reproducibility of the combination colors.

However, in the carrier for a two-component developer of the present exemplary embodiment, the above problem is not easily caused even if the trickle development system is used. Therefore, image formation that is excellent in the thin-line reproducibility of the combination colors may be performed.

The image holding member and the respective units may preferably use the configuration described in the respective processes of the image forming method. As for all the respective units, well-known units may be used in the image forming apparatus. Additionally, the image forming apparatus of the present exemplary embodiment may include units, devices, or the like other than the aforementioned configuration. Additionally, the image forming apparatus of the present exemplary embodiment may simultaneously operate plural units among the aforementioned units.

The process cartridge of the present exemplary embodiment includes a developing unit that develops an electrostatic latent image formed on an image holding member with the developer of the present exemplary embodiment containing a toner, to form a toner image and at least one kind selected from a group composed of an image holding member; a charging unit that charges the image holding member, and a cleaning unit that removes the toner remaining on the surface of the image holding member. Additionally, the process cartridge of the present exemplary embodiment is preferably detachable from an image forming apparatus.

Additionally, the process cartridge of the present exemplary embodiment may include other members, such as an erasing unit as required.

The cartridge, image forming apparatus, and process cartridge of the present exemplary embodiment will be specifically described below with reference to the drawings.

FIG. 1 is a cross-sectional view schematically showing the basic configuration of one preferred exemplary embodiment (first exemplary embodiment) of the image forming apparatus of the present exemplary embodiment. The image forming apparatus shown in FIG. 1 has a configuration including the cartridge of the present exemplary embodiment.

The image forming apparatus 10 shown in FIG. 1 includes an image holding member 12, a charging unit 14, an exposure unit 16, a developing unit 18, a transfer unit 20, a cleaning unit 22, an erasing unit 24, a fixing unit 26, and a cartridge 28.

In addition, the developer to be accommodated in the developing unit 18 and in the cartridge 28 is the developer of the present exemplary embodiment.

Additionally, although FIG. 1 shows only a configuration including one developing unit 18 and one cartridge 28 that accommodate the developer of the present exemplary embodiment for convenience, for example, in the case of a color image forming apparatus or the like, a configuration including developing units 18 and cartridges 28 in numbers according to the image forming apparatus may be adopted.

The image forming apparatus 10 shown in FIG. 1 is an image forming apparatus having a configuration capable of attaching and detaching the cartridge 28, and the cartridge 28 is connected to the developing unit 18 through a developer supply pipe 30. Hence, when an image is formed, an image using the developer of the present exemplary embodiment may be formed for a prolonged period of time by supplying the developer of the present exemplary embodiment accommodated in the cartridge 28 to the developing unit 18 through the developer supply pipe 30. Additionally, when an amount of the developer accommodated in the cartridge 28 is decreased, the cartridge 28 may be replaced.

A charging unit 14 that uniformly charges the surface of the image holding member 12, an exposure unit 16 that causes an electrostatic latent image to be formed on the surface of the image holding member 12 according to image information, a developing unit 18 that supplies the developer of the present exemplary embodiment to the formed electrostatic latent image, a drum-shaped transfer unit 20 that abuts on the surface of the image holding member 12 and is capable of rotating in the direction of an arrow B, following the rotation of the image holding member 12 in the direction of the arrow A, a cleaning unit 22 that abuts on the surface of the image holding member 12, and an erasing unit 24 that erases the surface of the image holding member 12 are arranged in this order along the rotational direction (the direction of an arrow A) of the image holding member 12 around the image holding member 12.

A recording medium 50 to be transported in the direction of an arrow C by a transporting unit (not shown) is capable of being inserted between the image holding member 12 and the transfer unit 20, from the side opposite to the direction of an arrow C. The fixing unit 26 having a heating source (not shown) built therein is arranged on the side of the image holding member 12 in the direction of the arrow C, and the fixing unit 26 is provided with an nip portion 32. Additionally, the recording medium 50 that has passed between the image holding member 12 and the transfer unit 20 is capable of being inserted through the nip portion 32 in the direction of the arrow C.

As the image holding member 12, for example, a photoconductor, a dielectric recording medium, or the like may be used As the photoconductor, for example, a photoconductor with single layer structure or a photoconductor with multilayer structure may be used. Additionally, as the material of the photoconductor, an inorganic photoconductor, such as selenium or amorphous silicon, an organic photoconductor, or the like is considered.

As the charging unit 14, for example, a well-known unit, such as a contact charging device using a conductive or semiconductive roller, brush, film, rubber blade, or the like or a noncontact charging device, such as corotron charging or scorotron charging using corona discharging, may be used.

As the exposure unit 16, in addition to well-known exposure units, a conventionally well-known unit capable of forming a signal that may form a toner image at a desired position on the surface of a recording medium may also be used.

As the exposure unit 16, for example, a conventionally well-known exposure unit, such as a combination of a semiconductor laser and a scanner, a laser scanning writer composed of an optical system, or an LED head, may be used. In order to realize a preferable aspect of making a uniform high-resolution exposure image, it is preferable to use a laser scanning writer or a LED head.

As the transfer unit 20, specifically, for example, a well-known unit, such as a unit that makes an electric field between the image holding member 12 and the recording medium 50, for example, using a conductive or semiconductive roller, brush, film, rubber blade, or the like to which a voltage is applied, and transfers a toner image composed of particles of a charged toner, or a unit that performs corona charging of the back of the recording medium 50 using a corotron charger, a scorotron charger, or the like, using corona discharging, to transfer the toner image composed of particles of the charged toner may be used.

Additionally, a secondary transfer unit may also be used as the transfer unit 20. That is, although not shown, the secondary transfer unit is a unit that first transfers a toner image to an intermediate transfer medium, and then secondarily transfers the toner image from the intermediate transfer medium to the recording medium 50.

Examples of the cleaning unit 22 include a cleaning blade, a cleaning brush, and the like.

Examples of the erasing unit 24 include a tungsten lamp, an LED, and the like.

As the fixing unit 26, for example, a heat fixing device that fixes a toner image by heating and pressurizing composed of a heating roller and a pressure roller, an optical fixing device that heats and fixes a toner image by the optical irradiation by a flash lamp or the like may be used.

A material that forms the surface of a roller, such as a heating roller or a pressure roller is preferably, for example, a material that is excellent in releasability with respect to a toner, silicone rubber, fluorine-based resin, or the like for the purpose of keeping a toner from adhering. In this case, it is preferable that a releasable liquid, such as silicone oil, not be applied to both sides of a roller. Although the releasable liquid is effective to make the fixing latitude large, since the liquid is transferred to a recording medium on which the image is fixed, problems may occur in that tackiness may occur in a printed matter on which an image is formed, tape may not stick, or characters may not be added with a magic marker. These problems become more striking in a case where a film, such as OHP, is used as the recording medium. Additionally, since the releasable liquid is difficult to make the roughness of the surface of a fixed image smooth, it may also become a factor that the image transparency that becomes particularly important when an OHP film is used as the recording medium, may deteriorate. However, since sufficient fixing latitude is exhibited when a wax (offset inhibitor) is included in a toner, a releasable liquid, such as silicone oil to be applied to a fixing roller, is not needed.

The recording medium 50 is not particularly limited, and conventionally well-known recording media including a regular paper, coated paper, and the like, may be used. Additionally, a recording medium having a base and an image receiving layer formed on the base may also be used.

Next, image formation using the image forming apparatus 10 will be described. First, a toner image is formed by charging the surface of the image holding member 12 by the charging unit 14 with the rotation of the image holding member 12 in the direction of the arrow A, forming an electrostatic latent image on the surface of the charged image holding member 12 according to image information by the exposure unit 16, and supplying the developer of the present exemplary embodiment to the surface of the image holding member 12 on which this electrostatic latent image is formed, from the developing unit 18, according to color information of the electrostatic latent image.

Next, the toner image formed on the surface of the image holding member 12 moves to a contact portion between the image holding member 12 and the transfer unit 20 with the rotation of the image holding member 12 in the direction of the arrow A. In this case, the recording medium 50 is inserted through the contact portion in the direction of arrow C by a paper transport roller (not shown), and the toner image formed on the surface of the image holding member 12 is transferred to the surface of the recording medium 50 at the contact portion by a voltage applied between the image holding member 12 and the transfer unit 20.

The surface of the image holding member 12 after the toner image is transferred to the transfer unit 20 has the toner remaining thereon removed by the cleaning blade of the cleaning unit 22, and is erased by the erasing unit 24.

When the recording medium 50 having the toner image transferred to the surface thereof in this way is transported to the nip portion 32 of the fixing unit 26, and passes through the nip portion 32, the recording medium is heated by the fixing unit 26 of which the surface of the nip portion 32 is heated by a built-in heating source (not shown). In this case, an image is formed as the toner image is fixed on the surface of the recording medium 50.

Figure 2:
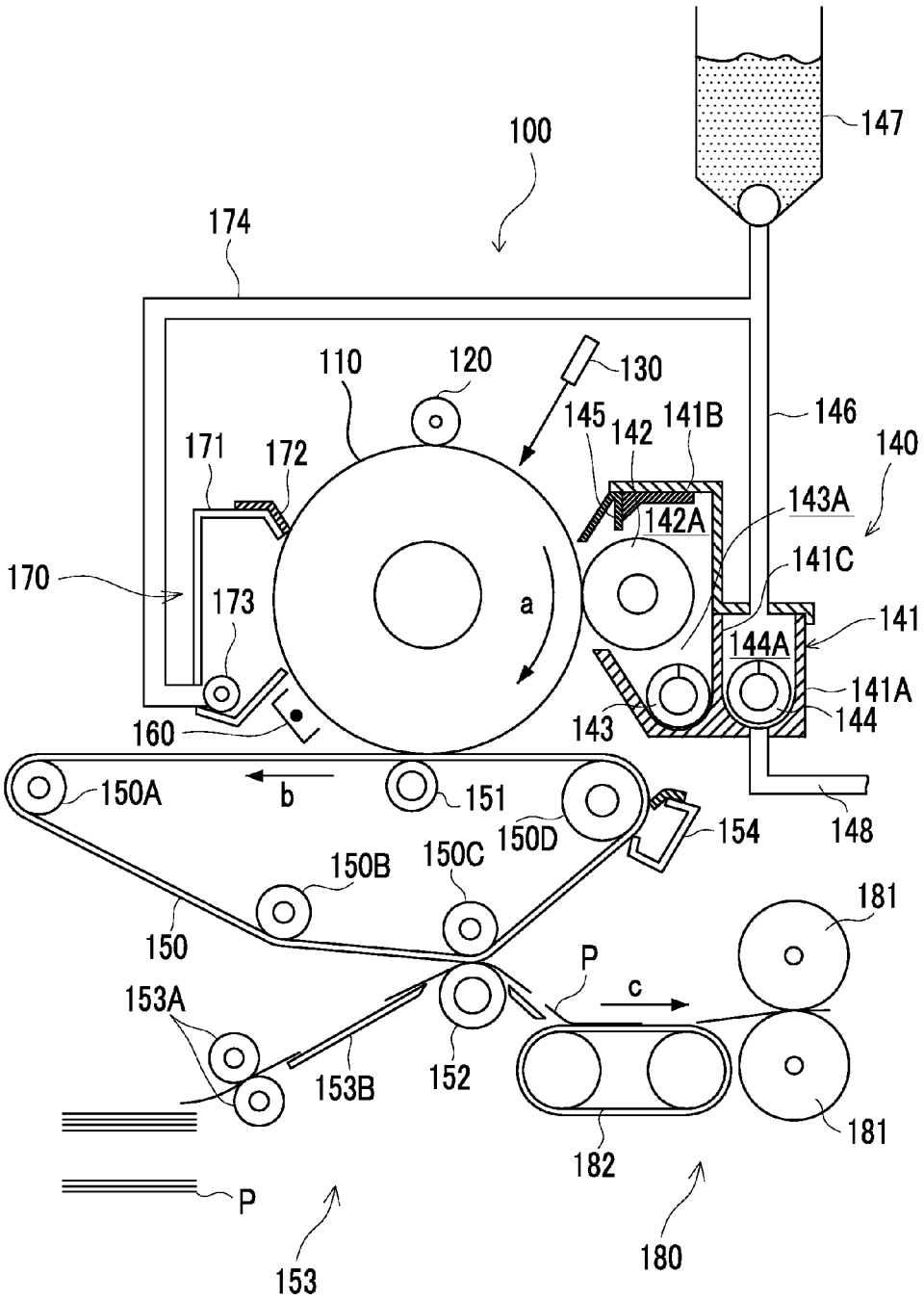
FIG. 2 is a cross-sectional view schematically showing the basic configuration of another preferred exemplary embodiment of the image forming apparatus of the present exemplary embodiment.

FIG. 2 is a cross-sectional view schematically showing the basic configuration of another preferred exemplary embodiment (second exemplary embodiment) of the image forming apparatus of the present exemplary embodiment.

The image forming apparatus shown in FIG. 2 has a configuration adopting a trickle development system that appropriately supplies the developer (developer for supply) of the present exemplary embodiment to a developer accommodating container in a developing unit by a developer supply unit, and appropriately discharges at least a portion of a developer accommodated in the developer accommodating container by a developer discharge unit.

The image forming apparatus 100 related to the exemplary embodiment of the present exemplary embodiment, as shown in FIG. 2, includes an image holding member 110 that rotates in the clockwise direction as indicated by an arrow a, a charging unit 120 that is provided above the image holding member 110 so as to face the image holding member 110 and negatively charges the surface of the image holding member 110, an exposure unit 130 that writes an image to be formed with a developer (toner) onto the surface of the image holding member 110 charged by the charging unit 120, to form an electrostatic latent image, a developing unit 140 that is provided on the downstream side of the exposure unit 130 to make the toner adhere to the electrostatic latent image formed by the exposure unit 130, to form a toner image on the surface of the image holding member 110, an endless-belt-shaped intermediate transfer belt 150 that travels in the direction indicated by an arrow b while abutting on the image holding member 110, and transfers the toner image formed on the surface of the image holding member 110, an erasing unit 160 that erases the surface of the image holding member 110 after the toner image is transferred to the intermediate transfer belt 150 to facilitate removal of the transfer residual toner remaining on the surface, and a cleaning unit 170 that cleans the surface of the image holding member 110 to remove the transfer residual toner.

The charging unit 120, the exposure unit 130, the developing unit 140, the intermediate transfer belt 150, the erasing unit 160, and the cleaning unit 170 are disposed in the clockwise direction on the circumference surrounding the image holding member 110.

The intermediate transfer belt 150 is tensioned and held by tension rollers 150A and 150B, a backup roller 1500, and a driving roller 150D from the inside, and is driven in the direction of an arrow b with the rotation of the driving roller 150D. A primary transfer roller 151 that positively charges the intermediate transfer belt 150 to make the toner on the image holding member 110 adsorb to the outer surface of the intermediate transfer belt 150 is provided at a position that faces the image holding member 110 inside the intermediate transfer belt 150. A secondary transfer roller 152 that positively charges a recording medium P to press the recording medium against the intermediate transfer belt 150 to transfer the toner image formed on the intermediate transfer belt 150 onto the recording medium P is provided outside a lower part of the intermediate transfer belt 150 so as to face the backup roller 150C.

A recording medium feeder 153 that feeds the recording medium P to the secondary transfer roller 152, and a fixing unit 180 that fixes a toner image while transporting the recording medium P having the toner image formed in the secondary transfer roller 152 are further provided below the intermediate transfer belt 150.

The recording medium feeder 153 includes a pair of transporting rollers 153A, and a guide slope 153B that guides the recording medium P transported by the transporting roller 153A toward the secondary transfer roller 152. On the other hand, the fixing unit 180 has a fixing roller 181 that is a pair of heat rollers that fixes the toner image by heating and pressing the recording medium P to which the toner image is transferred by the secondary transfer roller 152, and a transporting conveyor 182 that transports the recording medium P toward the fixing roller 181.

The recording medium P is transported in a direction indicated by an arrow c by the recording medium feeder 153, the secondary transfer roller 152, and the fixing unit 180.

An intermediate transfer medium cleaning unit 154 having a cleaning blade that removes the toner remaining on the intermediate transfer belt 150 after the toner image is transferred to the recording medium P in the secondary transfer roller 152 is further provided in the vicinity of the intermediate transfer belt 150.

The developing unit 140 will be described below in detail.

The developing unit 140 is arranged to face the image holding member 110 in a development region, and has, for example, a developer accommodating container 141 that accommodates a two-component developer composed of a toner to be charged with negative (−) polarity and a carrier to be charged with positive (+) polarity. The developer accommodating container 141 has a developer accommodating container body 141A and a developer accommodating container cover 141B that closes an upper end of the body.

The developer accommodating container body 141A has a developing roller chamber 142A that receives a developing roller 142 therein, and has a first agitating chamber 143A and a second agitating chamber 144A adjacent to the first agitating chamber 143A, in proximity to the developing roller chamber 142A. Additionally, a layer thickness regulating member 145 for regulating the layer thickness of the developer on the surface of the developing roller 142 when the developer accommodating container cover 141B is mounted on the developer accommodating container body 141A is provided within the developing roller chamber 142A.

The space between the first agitating chamber 143A and the second agitating chamber 144A is partitioned by a partition 1410. Although not shown, the first agitating chamber 143A and the second agitating chamber 144A have communicating parts at both ends of the partition wall 1410 in the longitudinal direction (the longitudinal direction of the developing device), and communicate with each other, and the first agitating chamber 143A and the second agitating chamber 144A constitute a circulation agitating chamber (143A+144A).

The developing roller 142 is arranged in the developing roller chamber 142A so as to face the image holding member 110. The developing roller 142 is formed by providing a sleeve outside a magnetic roller (stationary magnet) (not shown) that has magnetism. The developer of the first agitating chamber 143A is adsorbed on the surface of the developing roller 142 by the magnetic force of the magnetic roller, and is transported to the development region. Additionally, the developing roller 142 has a roller shaft rotatably supported by the developer accommodating container body 141A. Here, the developing roller 142 and the image holding member 110 rotate in opposite directions, and the developer adsorbed on the surface of the developing roller 142 is transported to a development region from the same direction as the traveling direction of the image holding member 110 in a facing portion.

Additionally, a bias power source (not shown) is connected to the sleeve of the developing roller 142 so as to apply a predetermined developing bias (in the present exemplary embodiment, a bias obtained by superimposing an alternating-current component (AC) on a direct-current component (DC) is applied so that an alternating electric field may be applied to the development region).

The first agitating member 143 (agitating and transporting member) and the second agitating member 144 (agitating and transporting member) that transport a developer while agitating the developer are arranged in the first agitating chamber 143A and the second agitating chamber 144A. The first agitating member 143 is constituted by a first rotating shaft that extends in the axial direction of the developing roller 142, and agitating and transporting blades (projection parts) spirally fixed to the outer periphery of the rotating shaft. Additionally, the second agitating member 144 is also similarly constituted by a second rotating shaft and agitating and transporting blades (projection parts). In addition, the agitating member is rotatably supported by the developer accommodating container body 141A. The first agitating member 143 and the second agitating member 144 are disposed so that the developer in the first agitating chamber 143A and the second agitating chamber 144A may be transported in mutually opposite directions by the rotation of the agitating members.

One end of a developer supply unit 146 for appropriately supplying a developer for supply containing a toner for supply and a carrier for supply to the second agitating chamber 144A is coupled to one longitudinal end of the second agitating chamber 144A, and a developer cartridge 147 that accommodates the developer for supply is coupled to the other end of the developer supply unit 146. Additionally, one end of the developer discharge unit 148 for appropriately discharging the accommodated developer is also coupled to one longitudinal end of the second agitating chamber 144A, and a developer collection container (not shown) that collects the discharged developer is coupled to the other end of the developer discharge unit 148.

As such, the developing unit 140 adopts a so-called trickle development system that appropriately supplies the developer for supply to the developing unit 140 (the second agitating chamber 144A) through the developer supply unit 146 from the developer cartridge 147, and appropriately discharges the aged developer from the developer discharge unit 148 (a development system that performs developing while gradually supplying the developer for supply (trickle developer) into the developing device, and discharging the excessive deteriorated developer (including a lot of deteriorated carrier), in order to prevent deterioration of the charging performance of the developer to extend the interval of developer replacement).

Here, in the present exemplary embodiment, the configuration using the developer cartridge 147 that accommodates the developer for supply of the present exemplary embodiment is shown as an example. However, as the developer cartridge 147, a cartridge that independently accommodates the toner for supply and a cartridge that independently accommodates the carrier for supply of the present exemplary embodiment are may be separately provided.

Next, the cleaning unit 170 will be described in detail. The cleaning unit 170 includes a housing 171, and a cleaning blade 172 disposed so as to protrude from the housing 171. The cleaning blade 172 is in the shape of a plate that extends in the extending direction of the rotating shaft of the image holding member 110, and is provided so that a tip portion (hereinafter referred to as an edge portion) thereof is contacted to the downstream side in the rotational direction (the direction of the arrow a) of the transfer position of the image holding member 110 by the primary transfer roller 151 and the downstream side in the rotational direction of the position of the image holding member erased by the erasing unit 160.

As the image holding member 110 rotates in a predetermined direction (the direction of the arrow a), the cleaning blade 172 dams up foreign matter, such as non-transferred residual toner carried on the image holding member 110 without being transferred to the recording medium P by the primary transfer roller 151, or debris of the recording medium P, and removes the foreign matter from the image holding member 110.

Additionally, the transporting member 173 is disposed at the bottom within the housing 171, and one end of a supply and transport unit 174 for supplying toner particles (developer) removed by the cleaning blade 172 to the developing unit 140 is coupled to the downstream side in the transporting direction of the transporting member 173 in the housing 171. The other end of the supply and transport unit 174 is coupled so as to join to the developer supply unit 146.

As such, the cleaning unit 170 adopts a toner reclaimer that transports non-transferred residual toner particles through the supply and transport unit 174 to the developing unit 140 (the second agitating chamber 144A), with the rotation of the transporting member 173 provided at the bottom of the housing 171, and stirs, transports, and reuses the residual toner particles with the accommodated developer (toner).

Figure 3:
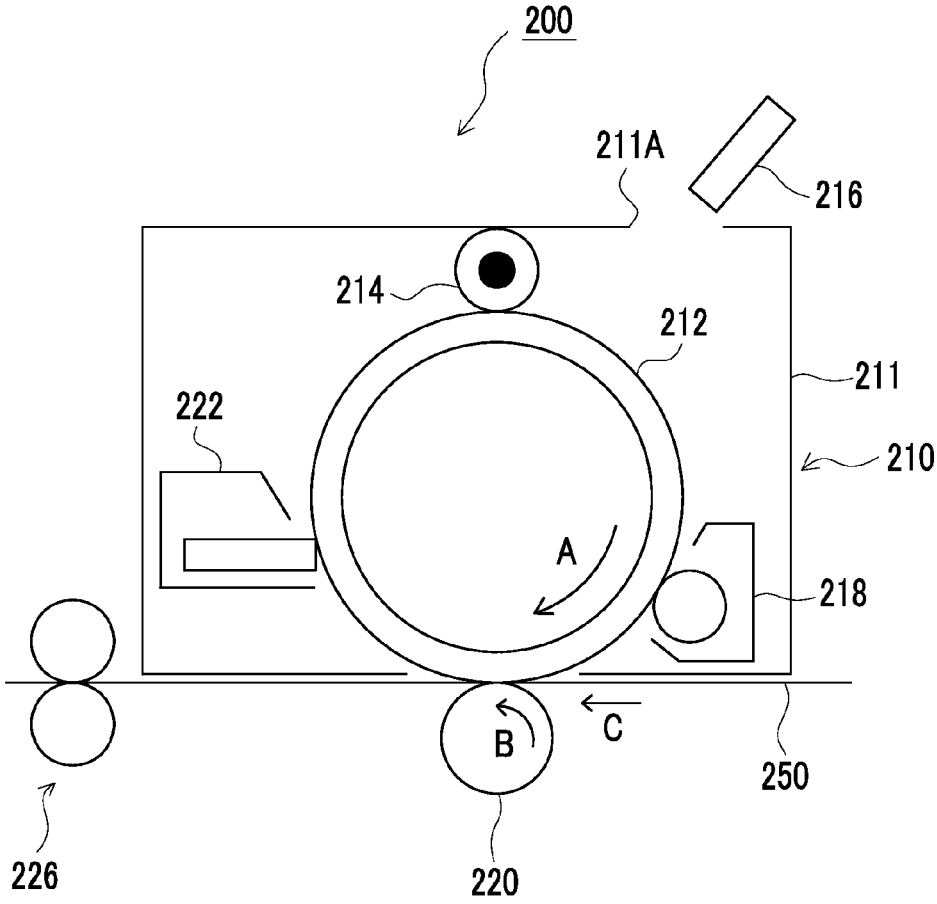
FIG. 3 is a cross-sectional view schematically showing the basic configuration of still another preferred exemplary embodiment of the image forming apparatus of the present exemplary embodiment.

FIG. 3 is a cross-sectional view schematically showing the basic configuration of still another preferred exemplary embodiment (third exemplary embodiment) of the image forming apparatus of the present exemplary embodiment.

The image forming apparatus shown in FIG. 3 has a configuration including the process cartridge of the present exemplary embodiment.

An image forming apparatus 200 shown in FIG. 3 includes a process cartridge 210 detachably disposed at an image forming apparatus body (not shown), an exposure unit 216, a transfer unit 220, and a fixing unit 226.

The process cartridge 210 is provided by integrating a charging unit 214, a developing unit 218, and a cleaning unit 222 around an image holding member 212 in combination by an attachment rail (not shown), together with the image holding member 212 within a housing 211 provided with an opening portion 211A for forming an electrostatic latent image. In addition, the process cartridge 210 is not limited to this, and may include the developing unit 218 and at least one kind selected from a group composed of the image holding member 212 and the charging unit 214, and the cleaning unit 222.

On the other hand, the exposure unit 216 is arranged at a position where a latent image is capable of being formed on the image holding member 212 from the opening portion 211A of the housing 211 of the process cartridge 210. Additionally, the transfer unit 220 is arranged at a position that faces the image holding member 212.

The individual details of the image holding member 212, the charging unit 214, the exposure unit 216, the developing unit 218, the transfer unit 220, the cleaning unit 222, the fixing unit 226, and the recording medium 250 are the same as those of the image holding member 12, the charging unit 14, the exposure unit 16, the developing unit 18, the transfer unit 20, the cleaning unit 22, the fixing unit 26, and the recording medium 50 in the image forming apparatus 10 in FIG. 1.

Additionally, image formation using the image forming apparatus 200 of FIG. 3 is also the same as image formation using the image forming apparatus 10 in FIG. 1.

EXAMPLES

Although the present exemplary embodiment will be described below in detail with examples, the present exemplary embodiment is not limited only to the examples shown below. In addition, the "parts" in the following descriptions shows "parts by weight" as long as there is no particular mention. Additionally, the following "primary particle diameter" represents a "volume average primary particle diameter".

<Method of Measuring Volume Average Primary Particle Diameter of Metal Boride Particles>

In order to observe the volume average primary particle diameter of metal boride particles in a coating layer of a carrier, the carrier is cut by a microtome and the section thereof is observed by a scanning electron microscope (SEM). In an image observed by the electron microscope, the primary particle diameter of the metal boride particles is measured. As for the each metal boride particles, a maximum diameter is adopted as the primary particle diameter, and this maximum diameter is converted into the volume by $4\pi\times(\text{Primary particle diameter}\times0.5)^3/3$ to obtain the volume primary particle diameter. At this time, 100 metal boride particles are observed, 50 metal boride particles are selected in descending order of the primary particle diameter, the volume primary particle diameters of the 50 metal boride particles is obtained, and the average value of the volume primary particle diameters is obtained as the volume average primary particle diameter.

In the scanning electron microscope, a largest diameter plane of a metal boride particle is not necessarily cut for measurement of a section. If a spherical diameter particle with a primary particle diameter of 100 μm is considered, the largest diameter becomes 100 μm. However if a cutting plane deviates from a center by 25 μm, the largest diameter becomes 71 μm, and if the cutting plane deviates from the center by 50 μm, the largest diameter is observed as 0 μm. This means that a greater difference is observed as the cutting plane deviates from the center even in the same particle. Thus, if the diameter of a particle is in the top 50% of the total primary particle diameter, the diameter falls within 71% of an original particle diameter. Therefore, in consideration of the particle diameter distribution of particles, 100 metal boride particles are observed as mentioned above, 50 metal boride particles are selected in descending order of the primary particle diameter, and the volume primary particle diameter of the 50 metal boride particles is obtained.

The volume primary particle diameters of the metal boride particles used in Examples are the values obtained from the carrier by the above method.

<Preparation of Carrier>

The metal boride particles used in Examples and Comparative Examples are as follows.

(Metal Boride Particles 1)

Vanadium diboride ($VB_2$) ($VB_2$—O made by Japanese New Metals Co., Ltd.) whose primary particle diameter is 2,800 nm is used as it is.

(Metal Boride Particles 2)

100 parts of Metal boride particles 1 are dispersed in 300 parts of ethyl alcohol to prepare a dispersion liquid, and ϕ4 mm of zirconia beads (Torayserum made by Toray Industries, Inc.) are added to the dispersion liquid to such a degree that the surface of the dispersion liquid is substantially filled, and are pulverized for 30 minutes by a bead mill (100 rpm). Then, the zirconia beads are removed and filtration is performed, and then Metal boride particles 1 are obtained by freeze-drying. The volume primary particle diameter of the metal boride particles 2 is 2,400 nm.

(Metal Boride Particles 3)

Metal boride particles 3 are obtained by the same method as for Metal boride particles 2 except that the pulverization time of the bead mill is changed to 1 hour from 30 minutes. The primary particle diameter of Metal boride particles 3 is 2,100 nm.

(Metal Boride Particles 4)

Metal boride particles 4 are obtained by the same method as for Metal boride particles 2 except that the pulverization time of the bead mill is changed to 2 hours from 30 minutes. The primary particle diameter of Metal boride particles 4 is 1,700 nm.

(Metal Boride Particles 5)

Metal boride particles 5 are obtained by the same method as for Metal boride particles 2 except that the pulverization time of the bead mill is changed to 4 hours from 30 minutes. The primary particle diameter of Metal boride particles 5 is 1,000 nm.

(Metal Boride Particles 6)

Metal boride particles 6 are obtained by the same method as for Metal boride particles 2 except that the pulverization time of the bead mill is changed to 6 hours from 30 minutes. The primary particle diameter of Metal boride particles 6 is 700 nm.

(Metal Boride Particles 7)

Metal boride particles 7 are obtained by the same method as for Metal boride particles 2 except that the pulverization time of the bead mill is changed to 9 hours from 30 minutes. The primary particle diameter of Metal boride particles 7 is 500 nm.

(Metal Boride Particles 8)

Metal boride particles 8 are obtained by the same method as for Metal boride particles 2 except that the pulverization time of the bead mill is changed to 12 hours from 30 minutes. The primary particle diameter of Metal boride particles 8 is 360 nm.

(Metal Boride Particles 9)

Metal boride particles 9 are obtained by the same method as for Metal boride particles 2 except that the pulverization time of the bead mill is changed to 18 hours from 30 minutes. The primary particle diameter of Metal boride particles 9 is 280 nm.

(Metal Boride Particles 10)

100 parts of chromium diboride ($CrB_2$) ($CrB_2$—O made by Japanese New Metals Co., Ltd.) whose volume primary particle diameter is 7,000 nm is dispersed in 300 parts of ethyl alcohol to prepare a dispersion liquid, and 0 mm of zirconia beads (Torayserum made by Toray Industries, Inc.) are added to the dispersion liquid to such a degree that the surface of the dispersion liquid is substantially filled, and are pulverized for 20 hours by a bead mill (100 rpm). Then, the zirconia beads are removed and filtration is performed, and then Metal boride particles 10 are obtained by freeze-drying. The volume primary particle diameter of the metal boride particles 10 is 1,300 nm.

—Preparation of Carrier 1—

Mn—Mg—Sr-Ferrite particles: 100 parts (True specific gravity $\rho$=4.6 g/cm$^3$, average particle diameter: 36.0 μm, and volume electric resistance: $10^8$ Ω·cm)

Toluene: 20 parts

Cyclohexyl methacrylate/dimethylamino ethyl methacrylate copolymer resin: 3 parts (Copolymerization ratio (molar ratio); cyclohexyl methacrylate/dimethylamino ethyl methacryate=99/1, weight average molecular weight Mw=9.8×$10^4$, and glass transition-temperature Tg=90° C.)

Metal boride particle 1: 0.2 part

Among the above components, cyclohexyl methacrylate/dimethylamino ethyl copolymer resin and Metal boride particles 1 are diluted with toluene, and then carbon black is added and the resulting mixture is stirred for 5 minutes by a homogenizer to prepare a resin solution.

Subsequently, this resin solution and Mn—Mg—Sr-Ferrite particles are put into a vacuum deaeration type kneader, and the resulting mixture is stirred for 30 minutes at 80° C. Thereafter, pressure is reduced over 10 minutes to 100 Pa at 80° C. to remove toluene, and a film is formed on the surfaces of the ferrite particles. Thereafter, the resin solution and Mn—Mg—Sr-Ferrite particles are put into the kneader again, and the resulting mixture is stirred for 30 minutes at 95° C. in atmospheric pressure. Thereafter, the heating of the kneader is turned off, and the mixture is taken out when the temperature becomes 70° C. The taken-out mixture is sifted with a net having a mesh of 75 μm to obtain Carrier 1.

—Preparation of Carrier 2—

Carrier 2 is obtained by the same method as for the preparation of Carrier 1 except that Metal boride particles 1 are substituted with Metal boride particles 2.

—Preparation of Carrier 3—

Carrier 3 is obtained by the same method as for the preparation of Carrier 1 except that Metal boride particles 1 are substituted with Metal boride particles 3.

—Preparation of Carrier 4—

Carrier 4 is obtained by the same method as for the preparation of Carrier 1 except that Metal boride particles 1 are substituted with Metal boride particles 4.

—Preparation of Carrier 5—

Carrier 5 is obtained by the same method as for the preparation of Carrier 1 except that Metal boride particles 1 are substituted with Metal boride particles 5.

—Preparation of Carrier 6—

Carrier 6 is obtained by the same method as for the preparation of Carrier 1 except that Metal boride particles 1 are substituted with Metal boride particles 6.

—Preparation of Carrier 7—

Carrier 7 is obtained by the same method as for the preparation of Carrier 1 except that Metal boride particles 1 are substituted with Metal boride particles 7.

—Preparation of Carrier 8—

Carrier 8 is obtained by the same method as for the preparation of Carrier 1 except that Metal boride particles 1 are substituted with Metal boride particles 8.

—Preparation of Carrier 9—

Carrier 9 is obtained by the same method as for the preparation of Carrier 1 except that Metal boride particles 1 are substituted with Metal boride particles 9.

—Preparation of Carrier 10—

Carrier 10 is obtained by the same method as for the preparation of Carrier 1 except that Metal boride particles 1 are substituted with Metal boride particles 10.

—Preparation of Carrier 11—

Carrier 11 is obtained by the same method as for the preparation of Carrier 5 except for cyclohexyl methacrylate/dimethylamino ethyl methacrylate copolymer resin used in Carrier 5 being substituted with methyl methacrylate/dimethylamino ethyl methacrylate copolymer resin (copolymerization ratio (molar ratio)); methyl methacrylate/dimethylamino ethyl methacryate=99/1, weight average molecular weight Mw=8.5×$10^4$, and glass transition-temperature Tg=101° C.).

—Preparation of Carrier 12—

Carrier 12 is obtained by the same method as for the preparation of Carrier 11 except that Metal boride particles 5 are substituted with Metal boride particles 8.

—Preparation of Carrier 13—

Carrier 13 is obtained by the same method as for the preparation of Carrier 11 except that Metal boride particles 5 are substituted with Metal boride particles 2.

<Preparation of Toner>

<Preparation of Toner 1>

(Colorant Dispersion Liquid 1)

Cyan pigment: copper phthalocyanine C.I. Pigment Blue 15:3 (Cyanine Blue 4937 made by Dainichiseika Colour & Chemicals Mfg. Co., Ltd.): 50 parts Anionic surfactant: Neogen SC (made by Dai-Ichi Kogyo Seiyaku Co., Ltd.): 5 parts Ion exchanged water: 200 parts Colorant dispersion liquid 1 with 21% of solid content is obtained by mixing the above components, and dispersing the mixture for 5 minutes by Ultra-Turrax made by IKA and further dispersing the mixture for 10 minutes by an ultrasonic bus. The volume average particle diameter is 160 nm when being measured in a particle diameter measuring instrument LA-700 made by Horiba, Ltd.

(Colorant Dispersion Liquid 2)

Colorant dispersion liquid 2 is prepared by the same method as for Colorant dispersion liquid 1 except that C.I. Pigment Red 122 (Chromofine Magenta 6887 made by Dainichiseika Colour & Chemicals Mfg. Co., Ltd.) is used instead of the cyan pigment.

(Colorant Dispersion Liquid 3)

Colorant dispersion liquid 3 is prepared by the same method as for Colorant dispersion liquid 1 except that C.I. Pigment Yellow 74 (KET Yellow 403 made by DIC Corp.) is used instead of the cyan pigment.

(Release Agent Dispersion Liquid 1)

Paraffin wax: HNP-9 (made by Nippon Seiro Co., Ltd.): 19 parts

Anionic surfactant: Neogen SC (made by Dai-Ichi Kogyo Seiyaku Co., Ltd.): 1 part Ion exchanged water: 80 parts The above components are mixed in a heat-resistant container, temperature is raised to 90° C., and stirring is performed for 30 minutes. Next, a melting liquid is cycled to a Gaulin homogenizer from the bottom of a container, and a 3-pass equivalent cycle operation is performed on the basis of the pressure condition of 5 MPa. Thereafter, the pressure is raised to 35 MPa, and a 3-pass equivalent cycle operation is performed. Release agent dispersion liquid 1 is obtained by cooling an emulsified liquid made in this way in a heat-resistant container until the temperature becomes 40° C. or lower.

(Binder Resin Particle Dispersion Liquid 1)

Ethylene glycol (made by Wako Pure Chemical Industries, Ltd.): 37 parts

Neopentyl glycol (made by Wako Pure Chemical Industries, Ltd.): 65 parts 1,9-nonane dial (made by Wako Pure Chemical Industries, Ltd.): 32 parts Terephthalic acid (made by Wako Pure Chemical Industries, Ltd.): 96 parts The above components are loaded into a flask, temperature is raised to 200° C. over 1 hour, it is checked that the inside of a reaction system is uniformly stirred, and then, 1.2 parts of dibutyltin oxide is supplied. Moreover temperature is raised to 240° C. over 6 hours from the above temperature while distilling away the water to be produced, a dehydration condensation reaction is further continued at 240° C. for 4 hours, and polyester resin in which the acid number is 9.4 mg KOH/g, the weight average molecular weight is 13,000, and the glass transition temperature is 62° C. is obtained. Next, this polyester resin is transported to a Cavitron CD1010 (made by Euro Tech Co., Ltd.) at a speed of 100 g/min in a molten state. 0.37 mass % concentration of diluted ammonia water formed by diluting reagent ammonia water with ion exchanged water is put into a separately prepared aqueous vehicle tank, and is transported to the Cavitron simultaneously with the polyester resin melting substance at a speed of 0.1 l/min while being heated at 120° C. by a heat exchanger. The Cavitron is operated on the conditions that the rotating speed of a rotor is 60 Hz and the pressure is 5 kg/cm$^2$, and dispersion liquid (binder resin particle dispersion liquid 1) of resin in which the average particle diameter is 160 nm, the solid content is 30%, the glass transition temperature is 62° C., and the weight average molecular weight Mw is 13,000 is obtained.

(Binder Resin Particle Dispersion Liquid 2)

—Oil Layer—

Stylene (made by Wako Pure Chemical Industries, Ltd.): 30 parts n-butyl acrylate (made by Wako Pure Chemical Industries, Ltd.): 10 parts β-carboxyethyl acrylate (made by Rhodia Nicca, Ltd.): 1.3 parts Dodecanethiol (made by Wako Pure Chemical Industries, Ltd.): 0.4 part —Water Layer 1—

Ion exchanged water: 17 parts

Anionic surfactant (Dowfax made by The Dow Chemical Company): 0.4 part

—Water Layer 2—

Ion exchanged water: 40 parts

Anionic surfactant (Dowfax made by The Dow Chemical Company): 0.05 part

Ammonium peroxodisulfate (made by Wako Pure Chemical Industries, Ltd.): 0.4 part The above oil layer components and the components of Water layer 1 are put into a flask, stirred, and mixed to obtain a monomer emulsified liquid. The components of the above water layer 2 are supplied into a reaction container, the inside of the container is replaced with nitrogen, and heating is made until the internal temperature of a reaction system becomes 75° C. in an oil bath while performing stirring. The monomer emulsified liquid is gradually dropped into the reaction container over 3 hours, and emulsion polymerization is performed. The polymerization is continued at 75° C. after the end of the dropping, and polymerization is ended after 3 hours.

When the glass transition temperature of the obtained resin particles is measured, the temperature is 53° C., and Binder resin particle dispersion liquid 2 whose weight average molecular weight Mw is 33,000 is obtained.

<Preparation of Toner 1a>

Binder resin particle dispersion liquid 1: 150 parts

Colorant dispersion liquid 1: 25 parts

Release agent dispersion liquid 1: 35 parts

Polyaluminum chloride: 0.4 part

Ion exchanged water: 100 parts

The above components are mixed and dispersed in a round flask made of stainless steel for 10 minutes using Ultra-Turrax T50 made by IKA, and then heated from 30° C. to 48° C. at 3° C./rain while stirring the inside of the flask in an oil bath for heating. After being held for 60 minutes at 48° C., 70 parts of Binder resin particle dispersion liquid 1 is gently added to this mixture. Thereafter, pH within the system is adjusted to 8.0 using a sodium hydroxide aqueous solution having a concentration 0.5 mol/L. Then, the flask made of stainless steel is sealed, the seal of the stirring shaft is sealed with a magnetic force, the resulting mixture is heated to 90° C. while continuing stirring, and held for 30 minutes. After the end of the holding, cooling is made at a temperature drop speed of 5° C./min, and filtration and cleaning with ion exchanged water are made. Then, solid liquid separation is performed by Nutche type suction filtration. This resultant is further dispersed using 3,000 parts of ion exchanged water at 30° C., and is stirred at 300 rpm for 15 minutes and is cleaned. This cleaning operation is repeated further 6 times, and solid liquid separation is performed using No. 5A filter paper by Nutche type suction filtration. Next, vacuum drying is continued for 24 hours to obtain toner particles.

When the volume average particle diameter $D_{50}$ of the toner particles is measured by the Coulter multisizer II type (made by the Beckmann Coulter Inc.), the volume average particle diameter is 5.7 μm, and the volume average particle diameter distribution index GSDv is 1.23. Moreover, 1.5 parts of silica ($SiO_2$) particles with an average primary particle diameter of nm subjected to surface hydrophobizing by hexamethyldisilazane, with respect to 100 parts of a toner, is added to the toner particles, and the resultant is mixed by the Henschel mixer to prepare Toner 1a.

<Preparation of Toner 1b>

The part by weight of the polyaluminum chloride is changed to 0.2 part without changing the kinds and amounts of Toner 1a, the binder resin particle dispersion liquid, the colorant dispersion liquid, the release agent dispersion liquid, and the ion exchanged water. Thereafter, mixing and dispersing are made in a round flask made of stainless steel for 20 minutes using Ultra-Turrax T50 made by IKA, and then 0.2 part of polyaluminum chloride is added over 5 minutes. Thereafter, heating is made from 30° C. to 48° C. at 3° C./min in the oil bath for heating while stirring the inside of the flask. Thereafter, operation is performed similarly to Toner 1a so as to obtain toner particles whose volume average particle diameter is 5.6 μm and the volume average particle diameter distribution index GSDv is 1.21. Moreover, silica particles are mixed similarly to Toner 1a so as to prepare Toner 1b.

<Preparation of Toner 1c>

The part by weight of the polyaluminum chloride is changed to 0.2 part without changing the kinds and amounts of Toner 1a, the binder resin particle dispersion liquid, the colorant dispersion liquid, the release agent dispersion liquid, and the ion exchanged water. Thereafter, mixing and dispersing are made in a round flask made of stainless steel for 20 minutes using Ultra-Turrax T50 made by IKA, and then 0.1 part of polyaluminum chloride is added over 3 minutes. Further, mixing and dispersing are performed for 10 minutes, and 0.1 part of polyaluminum chloride is added over 3 minutes. Thereafter, heating is made from 30° C. to 48° C. at 3° C./min in the oil bath for heating while stirring the inside of the flask. Thereafter, operation is performed similarly to Toner 1a so as to obtain toner particles whose volume average particle diameter is 5.7 μm and the volume average particle diameter distribution index GSDv is 1.19. Moreover, silica particles are mixed similarly to Toner 1a so as to prepare Toner 1c.

<Preparation of Toner 1d>

The part by weight of the polyaluminum chloride is changed to 0.15 part without changing the kinds and amounts of Toner 1a, the binder resin particle dispersion liquid, the colorant dispersion liquid, the release agent dispersion liquid, and the ion exchanged water. Thereafter, mixing and dispersing are made in a round flask made of stainless steel for 20 minutes using Ultra-Turrax T50 made by IKA, and then 0.15 part of polyaluminum chloride is added over 3 minutes. Further, mixing and dispersing are performed for 10 minutes, and 0.1 part of polyaluminum chloride is added over 3 minutes. Thereafter, heating is made from 30° C. to 48° C. at 2° C./min in the oil bath for heating while stirring the inside of the flask. Thereafter, operation is performed similarly to Toner 1a so as to obtain toner particles whose volume average particle diameter is 5.7 μm and the volume average particle diameter distribution index GSDv is 1.17. Moreover, silica particles are mixed similarly to Toner 1a so as to prepare Toner 1d.

<Preparation of Toners 2a to 2d>

Toners 2a to 2d are prepared by the same method as for Toners 1a to 1d except that Colorant dispersion liquid 2 is used instead of Colorant dispersion liquid 1 used in Toners 1a to 1d. As the GSDv of the individual toners, Toner 2a has 1.23, Toner 2b has 1.21, Toner 2c has 1.19, and Toner 2d has 1.17.

<Preparation of Toners 3a to 3d>

Toners 3a to 3d are prepared by the same method as for Toners 1a to 1d except that Colorant dispersion liquid 3 is used instead of Colorant dispersion liquid 1 used in Toners 1a to 1d. As the GSDv of the individual toners, Toner 3a has 1.24, Toner 3b has 1.21, Toner 3c has 1.19, and Toner 3d has 1.17.

<Preparation of Toner 4a>

Polyester resin (polycondensation substance of ethylene oxide 2 mol adduct of bisphenol A, cyclohexane dimethanol and terephthalic acid (composition ratio (molar ratio) 4:1:5), and weight average molecular weight Mw=11,000): 85 parts Paraffin wax: HNP-9 (made by Nippon Seiro Co., Ltd.): 9 parts Copper phthalocyanine C.I. Pigment Blue 15:3 (Cyanine Blue 4937 made by Dainichiseika Colour & Chemicals Mfg. Co., Ltd.): 6 parts The above respective components are sufficiently preliminarily mixed by the Henschel mixer, and are melted and kneaded at 160° C. by a double-screw roll mill, are finely pulverized by a jet mill after cooling. Further, classification is performed two times at cutting points of 7.2 μm and 4.8 μm by an elbow jet classifier (EJ-L-3 type LABO made by Nittetsu Mining Co., Ltd.) so as to obtain toner particles whose volume average particle diameter is 6.0 μm and the volume average particle diameter distribution index GSDv is 1.23. Moreover, silica particles are mixed similarly to Toner 1a so as to prepare Toner 4a.

<Preparation of Toner 4b>

Toner particles are prepared by the same method as for the preparation of Toner particles 4a except for performing the classification 3 times, and toner particles whose volume average particle diameter is 6.1 μm and volume average particle diameter distribution index GSDv is 1.21 are obtained. Moreover, silica particles are mixed similarly to Toner 1a so as to prepare Toner 4b.

<Preparation of Toner 4c>

Toner particles are prepared by the same method as for the preparation of Toner particles 4a except for performing the classification 4 times, and toner particles whose volume average particle diameter is 6.2 μm and volume average particle diameter distribution index GSDv is 1.19 are obtained. Moreover, silica particles are mixed similarly to Toner 1a so as to prepare Toner 4c.

<Preparation of Toner 4d>

Toner particles are prepared by the same method as for the preparation of Toner particles 4a except for performing the classification 6 times, and toner particles whose volume average particle diameter is 6.2 μm and volume average particle diameter distribution index GSDv is 1.17 are obtained. Moreover, silica particles are mixed similarly to Toner 1a so as to prepare Toner 4d.

<Preparation of Toners 5a to 5d>

Toners 5a to 5d are prepared by the same method as for Toners 4a to 4d except that C.I. Pigment Red 122 (Chromofine Magenta 6887 made by Dainichiseika Colour & Chemicals Mfg. Co., Ltd.) is used instead of C.I. Pigment Blue 15:3 used in Toners 4a to 4d. As the GSDv of the individual toners, Toner 5a has 1.23, Toner 5b has 1.21, Toner 5c has 1.19, and Toner 5d has 1.17.

<Preparation of Toners 6a to 6d>

Toners 6a to 6d are prepared by the same method as for Toners 4a to 4d except that C.I. Pigment Yellow 74 (KET Yellow 403 made by DIC) is used instead of C.I. Pigment Blue 15:3 used in Toners 4a-4d. As the GSDv of the individual toners, Toner 6a has 1.23, Toner 6b has 1.21, Toner 6c has 1.19, and Toner 6d has 1.17.

(Preparation of Developer and Replenishing Developer)

As for Toners is to 6d and Carriers 1 to 13, developers and replenishing developers are prepared based on the compositions of Table 1 or 2. In addition, 6 parts of toners to 94 parts of carriers are put into a V blender as for the developers, 80 parts of toners to 20 parts of carriers are put into the V blender as for the replenishing developers, and mixing is performed at 100 rev/min for 20 minutes so as to prepare Developers 1 to 78 and Replenishing Developers 1 to 45. When the replenishing developers are not used, the toners are used as they are. For each developer and each replenishing developer, three-color developers with different toner colors are prepared (for example, toners used for Developer 1 are 1d, 2d, and 3d, and Carrier 5 is used as the carrier. In this case, a developer is prepared for every color, and Developers 1 and Replenishing Developers 1 are prepared in three colors). Additionally, the compositions of the developers and the replenishing developers are not changed for each color.

(Evaluation)

Developers 1 to 78 and Replenishing Developers 1 to 45 described in Table 1 or 2 are used, and image output is performed by Apeos Port-II C4300 altered apparatus (one that allows an image to be output irrespective of the presence of a carrier within a replenishing developer, or even if no developer is put into the black developing device among the four developing devices) made by Fuji Xerox Co., Ltd.

As a method, cyan, magenta and yellow developers and replenishing developers (toners depending on evaluation) are put into the above image output device, and are first left for 24 hours in an environment where the room temperature is 10° C. and the humidity is 15%. Thereafter, 5,000 sheets of only solid yellow images (the amount of application is 6 g/m$^2$) are output. Thereafter, 10 sheets of images for evaluation (Color Chart No. D (A4) made by FUJIFILM Imagetec Co., Ltd.) are output, and green and red thin-line portions of the images are visually evaluated by a 10-times magnifying glass.

Sheets with no problem in the evaluation of the 5,000 sheets are regarded to be within an allowable range, and then, image evaluation based on every 1,000 sheets of solid images and the subsequent images for evaluation are repeated up to 20,000 sheets.

As for the evaluation, the evaluation is ended in the stage in which thin lines are not allowed, and as the number of sheets evaluated becomes larger, higher evaluation marks are given. It is noted that, if the sheets have no problem beyond 20,000, this is described as >20,000, and further evaluation is not performed.

The results are shown in Tables 3 and 4.

TABLE 1

| | Carrier | | | | Toner | | | |
|---|---|---|---|---|---|---|---|---|
| | | Metal Boride | | | | | | |
| | Type | Type | Particle Diameter (nm) | Coating Resin | Type | GSDv | Production Method | Replenishing Developer |
| Developer 1 | Carrier 5 | Vanadium Diboride | 1000 | CHMA | 1d, 2d, 3d | 1.17 | Aggregation Method | Replenishing Developer 1 |
| Developer 2 | Carrier 6 | Vanadium Diboride | 700 | CHMA | 1d, 2d, 3d | 1.17 | Aggregation Method | Replenishing Developer 2 |
| Developer 3 | Carrier 4 | Vanadium Diboride | 1700 | CHMA | 1d, 2d, 3d | 1.17 | Aggregation Method | Replenishing Developer 3 |
| Developer 4 | Carrier 5 | Vanadium Diboride | 1000 | CHMA | 1c, 2c, 3c | 1.19 | Aggregation Method | Replenishing Developer 4 |
| Developer 5 | Carrier 6 | Vanadium Diboride | 700 | CHMA | 1c, 2c, 3c | 1.19 | Aggregation Method | Replenishing Developer 5 |
| Developer 6 | Carrier 4 | Vanadium Diboride | 1700 | CHMA | 1c, 2c, 3c | 1.19 | Aggregation Method | Replenishing Developer 6 |
| Developer 7 | Carrier 5 | Vanadium Diboride | 1000 | CHMA | 1b, 1b, 1b | 1.21 | Aggregation Method | Replenishing Developer 7 |
| Developer 8 | Carrier 6 | Vanadium Diboride | 700 | CHMA | 1b, 1b, 1b | 1.21 | Aggregation Method | Replenishing Developer 8 |
| Developer 9 | Carrier 4 | Vanadium Diboride | 1700 | CHMA | 1b, 1b, 1b | 1.21 | Aggregation Method | Replenishing Developer 9 |
| Developer 10 | Carrier 5 | Vanadium Diboride | 1000 | CHMA | 1a, 2a, 3a | 1.23 | Aggregation Method | Replenishing Developer 10 |
| Developer 11 | Carrier 6 | Vanadium Diboride | 700 | CHMA | 1a, 2a, 3a | 1.23 | Aggregation Method | Replenishing Developer 11 |
| Developer 12 | Carrier 4 | Vanadium Diboride | 1700 | CHMA | 1a, 2a, 3a | 1.23 | Aggregation Method | Replenishing Developer 12 |
| Developer 13 | Carrier 7 | Vanadium Diboride | 500 | CHMA | 1d, 2d, 3d | 1.17 | Aggregation Method | Replenishing Developer 13 |
| Developer 14 | Carrier 8 | Vanadium Diboride | 340 | CHMA | 1d, 2d, 3d | 1.17 | Aggregation Method | Replenishing Developer 14 |
| Developer 15 | Carrier 7 | Vanadium Diboride | 500 | CHMA | 1c, 2c, 3c | 1.19 | Aggregation Method | Replenishing Developer 15 |
| Developer 16 | Carrier 8 | Vanadium Diboride | 340 | CHMA | 1c, 2c, 3c | 1.19 | Aggregation Method | Replenishing Developer 16 |
| Developer 17 | Carrier 7 | Vanadium Diboride | 500 | CHMA | 1b, 1b, 1b | 1.21 | Aggregation Method | Replenishing Developer 17 |
| Developer 18 | Carrier 8 | Vanadium Diboride | 340 | CHMA | 1b, 1b, 1b | 1.21 | Aggregation Method | Replenishing Developer 18 |
| Developer 19 | Carrier 7 | Vanadium Diboride | 500 | CHMA | 1a, 2a, 3a | 1.23 | Aggregation Method | Replenishing Developer 19 |
| Developer 20 | Carrier 8 | Vanadium Diboride | 340 | CHMA | 1a, 2a, 3a | 1.23 | Aggregation Method | Replenishing Developer 20 |
| Developer 21 | Carrier 3 | Vanadium Diboride | 2100 | CHMA | 1d, 2d, 3d | 1.17 | Aggregation Method | Replenishing Developer 21 |
| Developer 22 | Carrier 2 | Vanadium Diboride | 2400 | CHMA | 1d, 2d, 3d | 1.17 | Aggregation Method | Replenishing Developer 22 |
| Developer 23 | Carrier 3 | Vanadium Diboride | 2100 | CHMA | 1c, 2c, 3c | 1.19 | Aggregation Method | Replenishing Developer 23 |
| Developer 24 | Carrier 2 | Vanadium Diboride | 2400 | CHMA | 1c, 2c, 3c | 1.19 | Aggregation Method | Replenishing Developer 24 |
| Developer 25 | Carrier 3 | Vanadium Diboride | 2100 | CHMA | 1b, 1b, 1b | 1.21 | Aggregation Method | Replenishing Developer 25 |
| Developer 26 | Carrier 2 | Vanadium Diboride | 2400 | CHMA | 1b, 1b, 1b | 1.21 | Aggregation Method | Replenishing Developer 26 |
| Developer 27 | Carrier 3 | Vanadium Diboride | 2100 | CHMA | 1a, 2a, 3a | 1.23 | Aggregation Method | Replenishing Developer 27 |
| Developer 28 | Carrier 2 | Vanadium Diboride | 2400 | CHMA | 1a, 2a, 3a | 1.23 | Aggregation Method | Replenishing Developer 28 |
| Developer 29 | Carrier 10 | Chrome Boride | 1300 | CHMA | 1d, 2d, 3d | 1.17 | Aggregation Method | Replenishing Developer 29 |
| Developer 30 | Carrier 11 | Vanadium Diboride | 1000 | MMA | 1d, 2d, 3d | 1.17 | Aggregation Method | Replenishing Developer 30 |
| Developer 31 | Carrier 12 | Vanadium Diboride | 340 | MMA | 1d, 2d, 3d | 1.17 | Aggregation Method | Replenishing Developer 31 |
| Developer 32 | Carrier 13 | Vanadium Diboride | 2400 | MMA | 1d, 2d, 3d | 1.17 | Aggregation Method | Replenishing Developer 32 |
| Developer 33 | Carrier 12 | Vanadium Diboride | 340 | MMA | 1b, 1b, 1b | 1.21 | Aggregation Method | Replenishing Developer 33 |
| Developer 34 | Carrier 13 | Vanadium Diboride | 2400 | MMA | 1b, 1b, 1b | 1.21 | Aggregation Method | Replenishing Developer 34 |
| Developer 35 | Carrier 12 | Vanadium Diboride | 340 | MMA | 1a, 2a, 3a | 1.23 | Aggregation Method | Replenishing Developer 35 |
| Developer 36 | Carrier 13 | Vanadium Diboride | 2400 | MMA | 1a, 2a, 3a | 1.23 | Aggregation Method | Replenishing Developer 36 |

TABLE 1-continued

| | Carrier | | | | Toner | | | |
|---|---|---|---|---|---|---|---|---|
| | | Metal Boride | | | | | | |
| | Type | Type | Particle Diameter (nm) | Coating Resin | Type | GSDv | Production Method | Replenishing Developer |
| Developer 37 | Carrier 5 | Vanadium Diboride | 1000 | CHMA | 4d, 5d, 6d | 1.17 | Kneading Method | Replenishing Developer 37 |
| Developer 38 | Carrier 8 | Vanadium Diboride | 340 | CHMA | 4d, 5d, 6d | 1.17 | Kneading Method | Replenishing Developer 38 |
| Developer 39 | Carrier 2 | Vanadium Diboride | 2400 | CHMA | 4d, 5d, 6d | 1.17 | Kneading Method | Replenishing Developer 39 |
| Developer 40 | Carrier 8 | Vanadium Diboride | 340 | CHMA | 4c, 5c, 6c | 1.19 | Kneading Method | Replenishing Developer 40 |

TABLE 2

| | Carrier | | | | Toner | | | Replenishing |
|---|---|---|---|---|---|---|---|---|
| | | Metal Boride | | | | | | |
| | Type | Type | Particle Diameter (nm) | Coating Resin | Type | GSDv | Production Method | Developer |
| Developer 41 | Carrier 2 | Vanadium Diboride | 2400 | CHMA | 4c, 5c, 6c | 1.19 | Kneading Method | Replenishing Developer 41 |
| Developer 42 | Carrier 8 | Vanadium Diboride | 340 | CHMA | 4b, 5b, 6b | 1.21 | Kneading Method | Replenishing Developer 42 |
| Developer 43 | Carrier 2 | Vanadium Diboride | 2400 | CHMA | 4b, 5b, 6b | 1.21 | Kneading Method | Replenishing Developer 43 |
| Developer 44 | Carrier 8 | Vanadium Diboride | 340 | CHMA | 4a, 5a, 6a | 1.23 | Kneading Method | Replenishing Developer 44 |
| Developer 45 | Carrier 2 | Vanadium Diboride | 2400 | CHMA | 4a, 5a, 6a | 1.23 | Kneading Method | Replenishing Developer 45 |
| Developer 46 | Carrier 5 | Vanadium Diboride | 1000 | CHMA | 1d, 2d, 3d | 1.17 | Aggregation Method | None |
| Developer 47 | Carrier 8 | Vanadium Diboride | 340 | CHMA | 1d, 2d, 3d | 1.17 | Aggregation Method | None |
| Developer 48 | Carrier 2 | Vanadium Diboride | 2400 | CHMA | 1d, 2d, 3d | 1.17 | Aggregation Method | None |
| Developer 49 | Carrier 8 | Vanadium Diboride | 330 | CHMA | 1b, 1b, 1b | 1.21 | Aggregation Method | None |
| Developer 50 | Carrier 2 | Vanadium Diboride | 2400 | CHMA | 1b, 1b, 1b | 1.21 | Aggregation Method | None |
| Developer 51 | Carrier 8 | Vanadium Diboride | 340 | CHMA | 1a, 2a, 3a | 1.23 | Aggregation Method | None |
| Developer 52 | Carrier 2 | Vanadium Diboride | 2400 | CHMA | 1a, 2a, 3a | 1.23 | Aggregation Method | None |
| Developer 53 | Carrier 11 | Vanadium Diboride | 1000 | MMA | 1d, 2d, 3d | 1.17 | Aggregation Method | None |
| Developer 54 | Carrier 12 | Vanadium Diboride | 340 | MMA | 1d, 2d, 3d | 1.17 | Aggregation Method | None |
| Developer 55 | Carrier 13 | Vanadium Diboride | 2400 | MMA | 1d, 2d, 3d | 1.17 | Aggregation Method | None |
| Developer 56 | Carrier 12 | Vanadium Diboride | 340 | MMA | 1b, 1b, 1b | 1.21 | Aggregation Method | None |
| Developer 57 | Carrier 13 | Vanadium Diboride | 2400 | MMA | 1b, 1b, 1b | 1.21 | Aggregation Method | None |
| Developer 58 | Carrier 12 | Vanadium Diboride | 340 | MMA | 1a, 2a, 3a | 1.23 | Aggregation Method | None |
| Developer 59 | Carrier 13 | Vanadium Diboride | 2400 | MMA | 1a, 2a, 3a | 1.23 | Aggregation Method | None |
| Developer 60 | Carrier 5 | Vanadium Diboride | 1000 | CHMA | 4d, 5d, 6d | 1.17 | Kneading Method | None |
| Developer 61 | Carrier 8 | Vanadium Diboride | 340 | CHMA | 4d, 5d, 6d | 1.17 | Kneading Method | None |
| Developer 62 | Carrier 2 | Vanadium Diboride | 2400 | CHMA | 4d, 5d, 6d | 1.17 | Kneading Method | None |
| Developer 64 | Carrier 8 | Vanadium Diboride | 340 | CHMA | 4b, 5b, 6b | 1.21 | Kneading Method | None |
| Developer 65 | Carrier 2 | Vanadium Diboride | 2400 | CHMA | 4b, 5b, 6b | 1.21 | Kneading Method | None |
| Developer 66 | Carrier 8 | Vanadium Diboride | 340 | CHMA | 4a, 5a, 6a | 1.23 | Kneading Method | None |
| Developer 67 | Carrier 2 | Vanadium Diboride | 2400 | CHMA | 4a, 5a, 6a | 1.23 | Kneading Method | None |
| Developer 68 | Carrier 11 | Vanadium Diboride | 1000 | MMA | 4d, 5d, 6d | 1.17 | Kneading Method | None |
| Developer 69 | Carrier 12 | Vanadium Diboride | 340 | MMA | 4d, 5d, 6d | 1.17 | Kneading Method | None |
| Developer 70 | Carrier 13 | Chrome Diboride | 2400 | MMA | 4d, 5d, 6d | 1.17 | Kneading Method | None |
| Developer 71 | Carrier 12 | Vanadium Diboride | 340 | MMA | 4b, 5b, 6b | 1.21 | Kneading Method | None |
| Developer 72 | Carrier 13 | Vanadium Diboride | 2400 | MMA | 4b, 5b, 6b | 1.21 | Kneading Method | None |
| Developer 73 | Carrier 12 | Vanadium Diboride | 340 | MMA | 4a, 5a, 6a | 1.23 | Kneading Method | None |
| Developer 74 | Carrier 13 | Vanadium Diboride | 2400 | MMA | 4a, 5a, 6a | 1.23 | Kneading Method | None |
| Developer 75 | Carrier 1 | Vanadium Diboride | 2700 | CHMA | 1d, 2d, 3d | 1.17 | Aggregation Method | None |
| Developer 76 | Carrier 9 | Vanadium Diboride | 270 | CHMA | 1d, 2d, 3d | 1.17 | Aggregation Method | None |
| Developer 77 | Carrier 1 | Vanadium Diboride | 2700 | CHMA | 1a, 2a, 3a | 1.23 | Aggregation Method | None |
| Developer 78 | Carrier 9 | Vanadium Diboride | 270 | CHMA | 1a, 2a, 3a | 1.23 | Aggregation Method | None |

In addition, CHMA in Tables 1 and 2 represents cyclohexyl methacrylate/dimethylamino ethylmethacrylate copolymer resin, MMA represents methyl methacrylate/dimethylamino ethylmethacrylate copolymer resin, and the particle diameter expresses the volume average primary particle diameter.

TABLE 3

| | Developer | Replenishing Developer | Evaluation Results |
|---|---|---|---|
| Example 1 | Developer 1 | Replenishing Developer 1 | >20,000 |
| Example 2 | Developer 2 | Replenishing Developer 2 | >20,000 |
| Example 3 | Developer 3 | Replenishing Developer 3 | >20,000 |

TABLE 3-continued

| | Developer | Replenishing Developer | Evaluation Results |
|---|---|---|---|
| Example 4 | Developer 4 | Replenishing Developer 4 | 20,000 |
| Example 5 | Developer 5 | Replenishing Developer 5 | 20,000 |
| Example 6 | Developer 6 | Replenishing Developer 6 | 20,000 |

TABLE 3-continued

| | Developer | Replenishing Developer | Evaluation Results |
|---|---|---|---|
| Example 7 | Developer 7 | Replenishing Developer 7 | 19,000 |
| Example 8 | Developer 8 | Replenishing Developer 8 | 19,000 |
| Example 9 | Developer 9 | Replenishing Developer 9 | 19,000 |
| Example 10 | Developer 10 | Replenishing Developer 10 | 18,000 |
| Example 11 | Developer 11 | Replenishing Developer 11 | 18,000 |
| Example 12 | Developer 12 | Replenishing Developer 12 | 18,000 |
| Example 13 | Developer 13 | Replenishing Developer 13 | 18,000 |
| Example 14 | Developer 14 | Replenishing Developer 14 | 16,000 |
| Example 15 | Developer 15 | Replenishing Developer 15 | 18,000 |
| Example 16 | Developer 16 | Replenishing Developer 16 | 16,000 |
| Example 17 | Developer 17 | Replenishing Developer 17 | 17,000 |
| Example 18 | Developer 18 | Replenishing Developer 18 | 14,000 |
| Example 19 | Developer 19 | Replenishing Developer 19 | 16,000 |
| Example 20 | Developer 20 | Replenishing Developer 20 | 14,000 |
| Example 21 | Developer 21 | Replenishing Developer 21 | 18,000 |
| Example 22 | Developer 22 | Replenishing Developer 22 | 16,000 |
| Example 23 | Developer 23 | Replenishing Developer 23 | 18,000 |
| Example 24 | Developer 24 | Replenishing Developer 24 | 16,000 |
| Example 25 | Developer 25 | Replenishing Developer 25 | 17,000 |
| Example 26 | Developer 26 | Replenishing Developer 26 | 14,000 |
| Example 27 | Developer 27 | Replenishing Developer 27 | 18,000 |
| Example 28 | Developer 28 | Replenishing Developer 28 | 13,000 |
| Example 29 | Developer 29 | Replenishing Developer 29 | 19,000 |
| Example 30 | Developer 30 | Replenishing Developer 30 | 20,000 |
| Example 31 | Developer 31 | Replenishing Developer 31 | 16,000 |
| Example 32 | Developer 32 | Replenishing Developer 32 | 16,000 |
| Example 33 | Developer 33 | Replenishing Developer 33 | 14,000 |
| Example 34 | Developer 34 | Replenishing Developer 34 | 14,000 |
| Example 35 | Developer 35 | Replenishing Developer 35 | 14,000 |
| Example 36 | Developer 36 | Replenishing Developer 36 | 14,000 |
| Example 37 | Developer 37 | Replenishing Developer 37 | 19,000 |
| Example 38 | Developer 38 | Replenishing Developer 38 | 16,000 |
| Example 39 | Developer 39 | Replenishing Developer 39 | 16,000 |
| Example 40 | Developer 40 | Replenishing Developer 40 | 16,000 |

TABLE 4

| | Developer | Replenishing Developer | Evaluation Results |
|---|---|---|---|
| Example 41 | Developer 41 | Replenishing Developer 41 | 16,000 |
| Example 42 | Developer 42 | Replenishing Developer 42 | 14,000 |
| Example 43 | Developer 43 | Replenishing Developer 43 | 14,000 |
| Example 44 | Developer 44 | Replenishing Developer 44 | 14,000 |
| Example 45 | Developer 45 | Replenishing Developer 45 | 14,000 |
| Example 46 | Developer 46 | None | 19,000 |
| Example 47 | Developer 47 | None | 14,000 |
| Example 48 | Developer 48 | None | 14,000 |
| Example 49 | Developer 49 | None | 14,000 |
| Example 50 | Developer 50 | None | 14,000 |
| Example 51 | Developer 51 | None | 11,000 |
| Example 52 | Developer 52 | None | 11,000 |
| Example 53 | Developer 53 | None | 17,000 |
| Example 54 | Developer 54 | None | 14,000 |
| Example 55 | Developer 55 | None | 14,000 |
| Example 56 | Developer 56 | None | 11,000 |
| Example 57 | Developer 57 | None | 11,000 |
| Example 58 | Developer 58 | None | 11,000 |
| Example 59 | Developer 59 | None | 11,000 |
| Example 60 | Developer 60 | None | 17,000 |
| Example 61 | Developer 61 | None | 14,000 |
| Example 62 | Developer 62 | None | 14,000 |
| Example 63 | Developer 64 | None | 11,000 |
| Example 64 | Developer 65 | None | 11,000 |
| Example 65 | Developer 66 | None | 8,000 |
| Example 66 | Developer 67 | None | 8,000 |
| Example 67 | Developer 68 | None | 16,000 |
| Example 68 | Developer 69 | None | 11,000 |
| Example 69 | Developer 70 | None | 11,000 |
| Example 70 | Developer 71 | None | 8,000 |
| Example 71 | Developer 72 | None | 8,000 |
| Example 72 | Developer 73 | None | 8,000 |
| Example 73 | Developer 74 | None | 8,000 |

TABLE 4-continued

| | Developer | Replenishing Developer | Evaluation Results |
|---|---|---|---|
| Comparative Example 1 | Developer 75 | None | 5,000 |
| Comparative Example 2 | Developer 76 | None | 5,000 |
| Comparative Example 3 | Developer 77 | None | 5,000 |
| Comparative Example 4 | Developer 78 | None | 5,000 |

The following matters are clear from Tables 3 and 4.

If the carriers having the resin coating layer containing the metal boride particles whose volume average primary particle diameter is 300 to 2,500 nm are used, deterioration of the thin-line reproducibility is suppressed. Moreover, the deterioration of the thin-line reproducibility is further suppressed by using vanadium diboride for the metal boride particles and using polymers containing a constitutional unit originated from cycloalkyl methacrylate for the resin coating layer.

Additionally, the deterioration of the thin-line reproducibility is also suppressed by using toners with a narrow particle diameter distribution, using the aggregation method for the preparation method of the toners, and using the replenishing developers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for a two-component developer comprising:

magnetic particles, and a resin coating layer that covers the magnetic particles, wherein the resin coating layer contains metal boride particles having a volume average primary particle diameter of from about 300 nm to about 2,500 nm, the metal boride being a compound selected from the group consisting of dimetal monoboride, pentametal triboride, trimetal tetraboride, dimetal triboride, dimetal pentaboride, metal tetraboride, metal hexaboride, and metal dodecaboride.

2. The carrier for a two-component developer according to claim 1, wherein the resin coating layer contains a resin selected from a cyclohexyl methacrylate homopolymer or a cyclohexyl methacrylate copolymer.

3. The carrier for a two-component developer according to claim 1, wherein a volume electric resistance of the magnetic particles is within a range of from about $10^5$ Ω·cm to about $10^{9.5}$ Ω·cm.

4. The carrier for a two-component developer according to claim 1, wherein a volume electric resistance of the magnetic particles is within a range of from about $10^7$ Ω·cm to about $10^9$ Ω·cm.

5. The carrier for a two-component developer according to claim 1, wherein the volume average primary particle diameter of the metal boride particles is within a range of from about 500 nm to about 2,200 nm.

6. The carrier for a two-component developer according to claim 1, wherein the resin coating layer contains a conductive material.

7. The carrier for a two-component developer according to claim 6, wherein the conductive material is a white conductive material.

8. The carrier for a two-component developer according to claim 1, wherein an amount of the metal boride particles is within a range of from about 0.1% by weight to about 30% by weight to the total weight of the resin coating layer.

9. The carrier for a two-component developer according to claim 1, wherein a volume electric resistance of the carrier is within a range of from about $1\times10^{7}$ Ω·cm to about $1\times10^{15}$ Ω·cm.

10. A two-component developer containing:

the carrier for a two-component developer according to claim 1 and a toner.

11. The two-component developer according to claim 10, wherein a volume average particle diameter distribution index GSDv of the toner expressed by the following Equation (1) is 1.21 or less:

$$GSDv=\{(D_{84v})/(D_{16v})\}^{0.5} \quad (1)$$

wherein, $D_{84v}$ is a volume particle diameter at a cumulant of 84% and $D_{16v}$ is a volume particle diameter at a cumulant of 16% when a volume cumulative distribution curve is drawn from the smaller particle diameter side with respect to the divided particle diameter ranges.

12. The two-component developer according to claim 10, wherein the resin coating layer of the carrier for a two-component developer contains a resin selected from a cyclohexyl methacrylate homopolymer or a cyclohexyl methacrylate copolymer.

13. The two-component developer according to claim 10, wherein a shape factor SF1 of the toner is within a range of from about 110 to about 140.

14. An image forming method comprising:

charging an image holding member;

forming an electrostatic latent image on the surface of the image holding member;

developing the electrostatic latent image formed on the surface of the image holding member with an electrostatic charge image developer to form a toner image; and transferring the toner image formed on the surface of the image holding member to the surface of a transfer medium, wherein the electrostatic charge image developer is the two-component developer according to claim 10.

15. The image forming method according to claim 14, wherein a volume average particle diameter distribution index GSDv of the toner for electrostatic charge image development expressed by the following Equation (1) is 1.21 or less:

$$GSDv=\{(D_{84v})/(D_{16v})\}^{0.5} \quad (1)$$

wherein, $D_{84v}$ is a volume particle diameter at a cumulant of 84% and $D_{16v}$ is a volume particle diameter at a cumulant of 16% when a volume cumulative distribution curve is drawn from the smaller particle diameter side with respect to the divided particle diameter ranges.

16. An image forming apparatus comprising:

an image holding member;

a charging unit that charges the image holding member;

an exposure unit that exposes the charged image holding member to form an electrostatic latent image on the image holding member;

a developing unit that develops the electrostatic latent image with a developer to form a toner image; and a transfer unit that transfers the toner image from the image holding member to a transfer medium, wherein the electrostatic charge image developer is the two-component developer according to claim 10.

17. The image forming apparatus according to claim 16, wherein a volume average particle diameter distribution index GSDv of the toner for electrostatic charge image development expressed by the following Equation (1) is 1.21 or less:

$$GSDv=\{(D_{84v})/(D_{16v})\}^{0.5} \quad (1)$$

wherein, $D_{84v}$ is a volume particle diameter at a cumulant of 84% and $D_{16v}$ is a volume particle diameter at a cumulant of 16% when a volume cumulative distribution curve is drawn from the smaller particle diameter side with respect to the divided particle diameter ranges.

* * * * *